US011189297B1

(12) United States Patent
Nakagawa et al.

(10) Patent No.: US 11,189,297 B1
(45) Date of Patent: Nov. 30, 2021

(54) TUNABLE RESIDUAL ECHO SUPPRESSOR

(71) Applicant: Amazon Technologies, Inc., Seattle, WA (US)

(72) Inventors: Carlos Renato Nakagawa, San Jose, CA (US); Carlo Murgia, Santa Clara, CA (US); Berkant Tacer, Bellevue, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/895,262

(22) Filed: Jun. 8, 2020

Related U.S. Application Data

(63) Continuation-in-part of application No. 16/739,819, filed on Jan. 10, 2020.

(51) Int. Cl.
*G10L 21/0208* (2013.01)
*H04R 3/00* (2006.01)

(52) U.S. Cl.
CPC ..... *G10L 21/0208* (2013.01); *H04R 3/005* (2013.01); *G10L 2021/02082* (2013.01)

(58) Field of Classification Search
CPC ..... G10L 21/0208; G10L 15/20; G10L 2021/02082; H04R 3/005; H04R 3/20; H04R 2430/23
See application file for complete search history.

(56) References Cited

U.S. PATENT DOCUMENTS

2014/0003611 A1* 1/2014 Mohammad ..... H04B 3/20 381/66
2015/0112672 A1* 4/2015 Giacobello ..... G10L 21/0208 704/233

* cited by examiner

*Primary Examiner* — Yogeshkumar Patel
(74) *Attorney, Agent, or Firm* — Pierce Atwood LLP

(57) ABSTRACT

A multi-channel acoustic echo cancellation (AEC) system that includes a residual echo suppressor (RES) that dynamically controls an amount of attenuation to reduce distortion of local speech during double-talk conditions. The RES determines when double-talk conditions are present based on an echo return loss enhancement (ERLE) value. When the ERLE value is above a first threshold value but below a second threshold value, the RES reduces an amount of attenuation applied while generating an RES mask to pass local speech without distortion. When the ERLE value is below the first threshold value or above the second threshold value, the RES applies full attenuation while generating the RES mask in order to suppress a residual echo signal. To further improve RES processing, the RES may apply smoothing across time, smoothing across frequencies, or apply extra echo suppression processing to further attenuate the residual echo signal.

20 Claims, 21 Drawing Sheets

FIG. 6

Robust Variable Step-Size (RVSS) Weight Vector 610

$$w_p(m,n) = \begin{cases} w_p(m,n-1) + \mu \cdot \frac{x_p(m,n)}{\|x_p(m,n)\|^2} \cdot e^*(m,n) & if \ \frac{|e(m,n)|}{\|x_p(m,n)\|} \leq \sqrt{\delta} \\ w_p(m,n-1) + \mu \cdot \sqrt{\delta} \cdot csgn(e(m,n))^* \cdot \frac{x_p(m,n)}{\|x_p(m,n)\|} & if \ \frac{|e(m,n)|}{\|x_p(m,n)\|} > \sqrt{\delta} \end{cases}$$

Robust Variable Step-Size (RVSS) 620

$$\mu_{RVSS} = \min\left[\sqrt{\delta} \cdot \frac{\|x_p(m,n)\|}{|e(m,n)|}, 1\right]$$

RVSS Weight Vector 630

$$w_p(m,n) = w_p(m,n-1) + \mu_{RVSS} \cdot \mu_{fixed} \cdot \frac{x_p(m,n)}{\|x_p(m,n)\|^2} \cdot e^*(m,n)$$

FIG. 9

Update Condition 910

$$\frac{e(m,n)^2}{\|x_p(m,n)\|^2} < \delta$$

Threshold Parameter 920

$$\delta_{m,n} = \lambda\delta_{m,n-1} + (1-\lambda)\min\left(\delta_{m,n-1}, \frac{e(m,n)^2}{\|x_p(m,n)\|^2}\right)$$

Minimum Function 930

$$\delta_{m,n} = \max\left(\delta_{m,n}, \delta_{min}\right)$$

$$w_p(m,n) = w_p(m,n-1) + \mu_{RVSS} \cdot \mu_{VSS} \cdot \frac{x_p(m,n)}{\|x_p(m,n)\|^2} \cdot e^*(m,n)$$

RVSS Weight Vector 1340

$$w_p(m,n) = w_p(m,n-1) + \mu_{RVSS} \cdot \mu_{VAEC} \cdot \frac{x_p(m,n)}{\|x_p(m,n)\|^2} \cdot e^*(m,n)$$

TUNABLE RESIDUAL ECHO SUPPRESSOR

CROSS-REFERENCE TO RELATED APPLICATION DATA

This application is a continuation-in-part of, and claims the benefit of priority of, U.S. Non-Provisional patent application Ser. No. 16/739,819, filed Jan. 10, 2020 and entitled "ROBUST STEP-SIZE CONTROL FOR MULTI-CHANNEL ACOUSTIC ECHO CANCELLER," in the names of Carlos Renato Nakagawa, et al. The above utility application is herein incorporated by reference in its entirety.

BACKGROUND

In audio systems, automatic echo cancellation (AEC) refers to techniques that are used to recognize when a system has recaptured sound via a microphone after some delay that the system previously output via a speaker. Systems that provide AEC subtract a delayed version of the original audio signal from the captured audio, producing a version of the captured audio that ideally eliminates the "echo" of the original audio signal, leaving only new audio information. For example, if someone were singing karaoke into a microphone while prerecorded music is output by a loudspeaker, AEC can be used to remove any of the recorded music from the audio captured by the microphone, allowing the singer's voice to be amplified and output without also reproducing a delayed "echo" the original music. As another example, a media player that accepts voice commands via a microphone can use AEC to remove reproduced sounds corresponding to output media that are captured by the microphone, making it easier to process input voice commands.

BRIEF DESCRIPTION OF DRAWINGS

For a more complete understanding of the present disclosure, reference is now made to the following description taken in conjunction with the accompanying drawings.

FIG. 6 illustrates examples of determining a step-size parameter according to embodiments of the present disclosure.

FIG. 9 illustrates examples of performing cost function selection according to embodiments of the present disclosure.

DETAILED DESCRIPTION

Figure 1A:
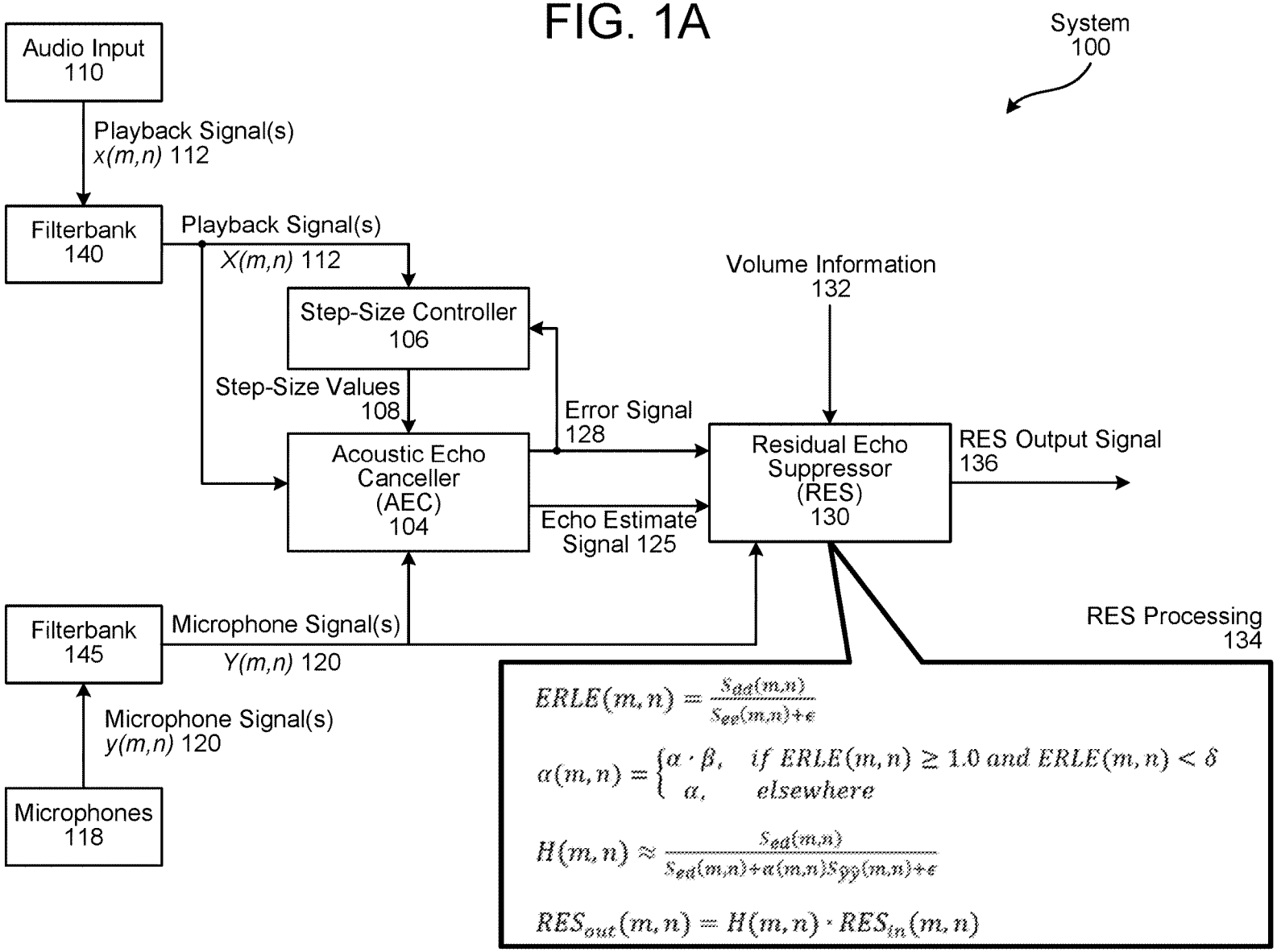
FIG. 1A illustrates an echo cancellation system that includes a tunable residual echo suppressor according to embodiments of the present disclosure.

Electronic devices may be used to capture and process audio data. The audio data may be used for voice commands and/or may be output by loudspeakers as part of a communication session. In some examples, loudspeakers may generate audio using playback audio data while a microphone generates local audio data. An electronic device may perform audio processing, such as acoustic echo cancellation (AEC), residual echo suppression (RES), and/or the like, to remove an "echo" signal corresponding to the playback audio data from the local audio data, isolating local speech to be used for voice commands and/or the communication session.

AEC systems eliminate undesired echo due to coupling between a loudspeaker and a microphone. The main objective of AEC is to identify an acoustic impulse response in order to produce an estimate of the echo (e.g., estimated echo signal) and then subtract the estimated echo signal from the microphone signal. Due to internal coupling and nonlinearity in the acoustic path from the loudspeakers to the microphone, performing AEC processing may result in distortion and other signal degradation such that the output of the AEC includes a residual echo signal. In some examples, this distortion may be caused by imprecise time alignment between the playback audio data and the local audio data, which may be caused by variable delays, dropped packets, clock jitter, clock skew, and/or the like.

A RES component may perform residual echo suppression to eliminate the residual echo signal included in the AEC output. For example, during a communication session the RES component may attenuate all frequency bands when only remote speech is present (e.g., far-end single-talk conditions) and pass all frequency bands when only local speech is present (e.g., near-end single-talk conditions). When both remote speech and local speech is present (e.g., double-talk conditions), the RES component makes a tradeoff between attenuating the residual echo signal but potentially distorting the local speech, or passing the local speech without attenuating the residual echo signal.

To improve residual echo suppression, devices, systems and methods are disclosed for dynamically controlling an amount of attenuation applied during residual echo suppression. The amount of attenuation may be used to generate a RES mask that is individually controlled for each frequency subband (e.g., range of frequencies, referred to herein as a tone index) on a frame-by-frame basis (e.g., dynamically changing over time). The system may reduce the amount of attenuation when both the remote speech and the local speech are present.

The system may determine when these conditions are present by determining an echo return loss enhancement (ERLE) value, which corresponds to a ratio of a first power spectral density of the AEC input and a second power spectral density of the AEC output. When the ERLE value is above a first threshold value (e.g., 1.0) but still relatively low (e.g., below a second threshold value), the system may determine that double-talk conditions are present and may reduce the amount of attenuation applied to generate the RES mask, thus passing local speech without distortion. When the ERLE value is below the first threshold value or above the second threshold value, however, the system does not reduce the amount of attenuation in order to suppress the residual echo signal. To further improve the RES mask, the system may smooth the RES mask across time, may smooth the RES mask across frequency subbands, and/or may apply extra echo suppression (EES) processing to further attenuate the residual echo signal.

FIG. 1A illustrates a high-level conceptual block diagram of an echo cancellation system that includes a tunable residual echo suppressor according to embodiments of the present disclosure. In some examples, the system 100 may comprise a device 102 that may include an audio input 110, microphones 118, an acoustic echo canceller (AEC) component 104, a step-size controller 106, a residual echo suppressor (RES) component 130, a first filterbank 140, and a second filterbank 145, although the disclosure is not limited thereto and the device 102 may include additional components not illustrated in FIG. 1A.

As illustrated in FIG. 1A, the audio input 110 may provide playback signal(s) x(m,n) 112, which corresponds to playback audio data sent to loudspeakers 114 of the device 102 to generate output audio. The number of playback signal(s) x(m,n) 112 may correspond to a number of loudspeakers 114 associated with the system 100 and may vary without departing from the disclosure. As shown in FIG. 1A, the first filterbank 140 may receive the playback signal(s) x(m,n) 112 in a time domain and may generate playback signal(s) X(m,n) 112 in a frequency domain or subband domain, as described in greater detail below with regard to FIGS. 2A-2C.

The microphones 118 may capture input audio and generate microphone signal(s) y(m,n) 120. The number of microphone signal(s) y(m,n) 120 may correspond to a number of microphones 118 associated with the system 100 and may vary without departing from the disclosure. As described in greater detail below with regard to FIG. 1B, the microphone signal(s) y(m,n) 120 may include a representation of local speech, a portion of the output audio generated by the loudspeakers 114 (e.g., an echo signal), and/or noise or other audible sounds. The second filterbank 145 may receive the microphone signal(s) y(m,n) 120 in the time domain and may generate microphone signal(s) Y(m,n) 120 in the frequency domain or subband domain.

The AEC component 104 may receive the playback signal(s) X(m,n) 112 and the microphone signal(s) Y(m,n) 120 and may perform acoustic echo cancellation to generate an echo estimate signal 125 and an error signal 128. For example, the AEC component 104 may use adaptive filters to determine an estimate of the echo signal recaptured by the microphones 118 and generate the echo estimate signal 125, which will be described in greater detail below with regard to FIG. 1B. The AEC component 104 may then subtract the echo estimate signal 125 from the playback signal(s) X(m,n) 112 to generate the error signal 128. Thus, the AEC component 104 performs echo cancellation to remove the echo estimate signal 125 from the playback signal(s) X(m,n) 112, such that the error signal 128 corresponds to the local speech.

The step-size controller 106 may receive the playback signal(s) X(m,n) 112 and the error signal 128 and may determine step-size values 108. The step-size values may be determined for individual channels (e.g., microphone signals 120) and/or tone indexes (e.g., frequency subbands) on a frame-by-frame basis. The step-size values 108 are used by the AEC component 104 to update the adaptive filters, as described in greater detail below. While not illustrated in FIG. 1A, the step-size controller 106 may receive microphone signal(s) Y(m,n) 120, the echo estimate signal 125, and/or other signals without departing from the disclosure.

While FIG. 1A illustrates a single AEC component 104, the disclosure is not limited thereto and the device 102 may include multiple AEC components 104 and/or the AEC component 104 may be a multi-channel acoustic echo canceller (MC-AEC) component without departing from the disclosure. Thus, the device 102 may use each reference signal x(m,n) 112 to perform AEC processing on each microphone signal y(m,n) 120 generated by microphones 118 without departing from the disclosure. While the following description refers only to a single acoustic echo canceller 104, the concepts may be applied to multiple AEC components 104 without departing from the disclosure. Similarly, for ease of illustration, FIG. 1A and a corresponding description may refer to a single echo estimate signal 125 and a single error signal 128 generated by the AEC component 104. However, the disclosure is not limited thereto, and the device 102 may generate multiple echo estimate signals and/or multiple error signals without departing from the disclosure.

As illustrated in FIG. 1A, the RES component 130 may receive the microphone signal(s) Y(m,n) 120, the echo estimate signal 125, the error signal 128, and/or volume information 132 and may perform residual echo suppression (RES) processing 134 to generate a RES output signal 136. For example, the RES component 130 may generate a RES mask that indicates an amount of attenuation to apply to each frequency subband. The RES component 130 may apply the RES mask to the error signal 128 to perform residual echo suppression and generate the RES output signal 136.

In some examples, the RES component 130 may determine the RES mask based on an echo return loss enhancement (ERLE) value. As illustrated in FIG. 1A, the RES component 130 may determine the ERLE value by calculating a ratio of a first power spectral density of the AEC input (e.g., microphone signal(s) Y(m,n) 120) and a second power spectral density of the AEC output (e.g., error signal 128), as shown below:

$$ERLE(m, n) = \frac{S_{dd}(m, n)}{S_{ee}(m, n) + \epsilon} \quad [1]$$

where m denotes a subband bin index (e.g., frequency bin), n denotes a subband sample index (e.g., frame index), ERLE(m,n) is the ERLE value for the mth subband bin index and the nth subband sample index, $S_{dd}(m,n)$ is the power spectral density of the microphone signal(s) Y(m,n) 120 for the mth subband bin index and the nth subband sample index, $S_{ee}(m, n)$ is the power spectral density of the error signal 128 for the mth subband bin index and the nth subband sample index, and E is a nominal value.

While FIG. 1A illustrates an example of the RES component 130 determining the RES mask based on the ERLE value, the disclosure is not limited thereto and the RES component 130 may use any signal quality metric to determine the RES mask without departing from the disclosure. For ease of illustration, the following description refers to the example of using the ERLE value to determine the attenuation value and/or the RES mask value. However, one of skill in the art may apply the techniques described herein to determine the attenuation value and/or the RES mask value using any signal quality metric known to one of skill in the art.

When the ERLE value is above a first threshold value (e.g., 1.0) but still relatively low (e.g., below a second threshold value), the RES component 130 may determine that local speech is present in the subband bin index and may reduce the amount of attenuation applied to generate the RES mask, thus passing the local speech without distortion. For example, the ERLE value being closer to a value of one indicates that the second power spectral density of the error signal 128 is large relative to the first power spectral density of the microphone signal(s) Y(m,n) 120.

When the ERLE value is below the first threshold value or above the second threshold value, however, the RES component 130 does not reduce the amount of attenuation in order to suppress the residual echo signal. For example, an ERLE value below the first threshold value may indicate that echo cancellation has diverged or not yet converged, so the RES component 130 may apply aggressive residual echo suppression. In contrast, an ERLE value above the second threshold value indicates that far-end single talk conditions are present (e.g., local speech is not present), so the RES component 130 may apply residual echo suppression without distorting local speech.

An equation for calculating an attenuation value $\alpha(m, n)$ is shown below:

$$\alpha(m, n) = \begin{cases} \alpha \cdot \beta, & \text{if } ERLE(m, n) \geq 1.0 \text{ and } ERLE(m, n) < \delta \\ \alpha, & \text{elsewhere} \end{cases} \quad [2]$$

where m denotes a subband bin index (e.g., frequency bin), n denotes a subband sample index (e.g., frame index), $\alpha(m, n)$ denotes an attenuation value for the mth subband bin index and the nth subband sample index, a denotes a first tunable parameter, $\beta$ denotes a second tunable parameter, ERLE(m,n) is the ERLE value for the mth subband bin index and the nth subband sample index, 1.0 is a first threshold value, and $\delta$ is a second threshold value.

Using Equation [2] shown above, the RES component 130 may set the attenuation value $\alpha(m, n)$ to a first value (e.g., $\alpha \cdot \beta$) when the ERLE value is between the first threshold value and the second threshold value (e.g., $1.0 \leq ERLE(m,n) < \delta$). However, when the ERLE value is below the first threshold value (e.g., $ERLE(m,n) < 1.0$) or above the second threshold value (e.g., $ERLE(m,n) \geq 6$), the RES component 130 may set the attenuation value $\alpha(m, n)$ to a second value (e.g., a).

While FIG. 1A and Equation [2] illustrate a specific example of the first threshold value (e.g., 1.0), the disclosure is not limited thereto and the first threshold value may vary without departing from the disclosure. Similarly, the second threshold value $\delta$ may vary without departing from the disclosure. In some examples, the system 100 may dynamically select different values for the second threshold value $\delta$ depending on current conditions, although the disclosure is not limited thereto and the second threshold value $\delta$ may have a fixed value without departing from the disclosure.

The first tunable parameter $\alpha$ is a value between 0 and 1 (e.g., $0<\alpha<1$) that is selected by the device 102 based on a performance of the AEC component 104. For example, the device 102 may collect data and iteratively change the first tunable parameter $\alpha$ depending on an amount of echo leakage (e.g., echo signal represented in the error signal 128) and/or a type of echo leakage. To illustrate an example, if the error signal 128 includes nonlinear echo signals, the device 102 may select a relatively higher value for the first tunable parameter $\alpha$ (e.g., $\alpha=0.9$), which corresponds to a more aggressive RES mask. In contrast, if the echo signal is not represented in the error signal 128, the device 102 may select a relatively smaller value for the first tunable parameter $\alpha$ (e.g., $\alpha=0.3$), which corresponds to a less aggressive RES mask.

A more aggressive RES mask suppresses more of the residual echo signal, which improves performance of the RES component 130 during far-end single-talk conditions. However, the more aggressive RES mask causes distortion to local speech during double-talk conditions. To compensate for this, the RES component 130 reduces the attenuation value $\alpha(m, n)$ using the second tunable parameter $\beta$ during double-talk conditions. The second tunable parameter $\beta$ is a value between 0 and 1 (e.g., $0<\beta<1$) that reduces the attenuation value $\alpha(m, n)$ relative to the first tunable parameter $\alpha$, resulting in the RES mask being less aggressive during double-talk conditions. To illustrate an example, the RES component 130 may set the second tunable parameter $\beta$ to a value of 0.5 (e.g., $\beta=0.5$), such that the RES component 130 reduces the attenuation value by half. Thus, the first value is equal to the first tunable parameter $\alpha$ and the second value is equal to half of the first tunable parameter (e.g., 0.5a). However, the disclosure is not limited thereto and the value of the second tunable parameter $\beta$ may vary without departing from the disclosure.

In some examples, the device 102 may dynamically select the second tunable parameter $\beta$ based on the first tunable parameter $\alpha$. For example, if the first tunable parameter $\alpha$ is relatively large, the RES component 130 may select a relatively small value for the second tunable parameter $\beta$ without departing from the disclosure. To illustrate an example, if the first tunable parameter α is tuned to be more aggressive (e.g., α=0.8), the RES component 130 may set the second tunable parameter β to a relatively smaller value (e.g., closer to a value of 0, such as β=0.5). Thus, when the local speech is present, the RES component 130 makes the RES mask significantly less aggressive as the attenuation value α(m, n) is lower (e.g., α(m,n)=0.4). In contrast, if the first tunable parameter α is tuned to be less aggressive (e.g., α=0.3), the RES component 130 may set the second tunable parameter β to a relatively larger value (e.g., closer to a value of one, such as β=0.9). Thus, when the local speech is present, the RES component 130 makes the RES mask slightly less aggressive (e.g., α(m,n)=0.27).

In some examples, the first tunable parameter α may be volume dependent. For example, the device 102 may select the first tunable parameter α based on the volume information 132 corresponding to the output audio generated by the loudspeakers 114. Thus, the higher the volume level being used to generate output audio, the higher the device 102 selects the first tunable parameter α. In contrast, the lower the volume level being used to generate output audio, the lower the device 102 selects the first tunable parameter α. However, the disclosure is not limited thereto and the device 102 may select the first tunable parameter α using any techniques known to one of skill in the art without departing from the disclosure.

As illustrated in FIG. 1A, the RES component 130 may generate the RES mask using the attenuation value α(m, n) determined using Equation [2], as shown below:

$$H(m, n) \approx \frac{S_{ed}(m, n)}{S_{ed}(m, n) + \alpha(m, n) S_{\hat{y}\hat{y}}(m, n) + \epsilon} \quad [3]$$

where m denotes a subband bin index (e.g., frequency bin), n denotes a subband sample index (e.g., frame index), H(m, n) is the RES mask value for the mth subband bin index and the nth subband sample index, $S_{ed}$(m, n) is the cross power spectral density (e.g., cross spectral density) of the error signal 128 and the microphone signal(s) Y(m,n) 120, α(m, n) is the attenuation value determined using Equation [2], $S_{\hat{y}\hat{y}}$(m, n) is the power spectral density of the echo estimate signal 125, and ϵ is a nominal value.

When the attenuation value α(m, n) is relatively high (e.g., closer to a value of 1), the RES component 130 applies more attenuation or suppression, as the RES mask value is lower. For example, the attenuation value α(m, n) being relatively high increases the contribution of the power spectral density $S_{\hat{y}\hat{y}}$(m, n) represented in the denominator of Equation [3], decreasing the value of the RES mask value H(m, n). In contrast, when the attenuation value α(m, n) is relatively low (e.g., closer to a value of 0), the RES component 130 applies less attenuation or suppression, as the RES mask value is closer to a value of one. For example, the attenuation value α(m, n) being relatively low reduces the contribution of the power spectral density $S_{\hat{y}\hat{y}}$(m,n) represented in the denominator of Equation [3], increasing the value of the RES mask value H(m, n). Thus, the RES component 130 may determine a more aggressive mask value (e.g., lower RES mask value, such as H(m, n)=0.5) when the attenuation value α(m, n) is equal to the first value (e.g., α) and may determine a less aggressive mask value (e.g., higher RES mask value, such as H(m, n)=0.9) when the attenuation value α(m, n) is equal to the second value (e.g., α·β), although the disclosure is not limited thereto.

After determining the RES mask values H(m, n), the RES component 130 may generate the RES output signal 136 by applying the RES mask values H(m, n) to the error signal 128, as shown below:

$$\mathrm{RES}_{out}(m,n) = H(m,n) \cdot \mathrm{RES}_{in}(m,n) \quad [4]$$

where m denotes a subband bin index (e.g., frequency bin), n denotes a subband sample index (e.g., frame index), RE $S_{out}$(m, n) is the RES output signal 136 generated by the RES component 130, H(m, n) is the RES mask value for the mth subband bin index and the nth subband sample index, and $\mathrm{RES}_{in}$(m, n) is the error signal 128 input to the RES component 130.

To further improve the RES output signal 136, the RES component 130 may smooth the RES mask across time, may smooth the RES mask across frequency subbands, and/or may apply extra echo suppression (EES) processing to further attenuate the residual echo signal, as described in greater detail below with regard to FIGS. 15-19.

Figure 1B:
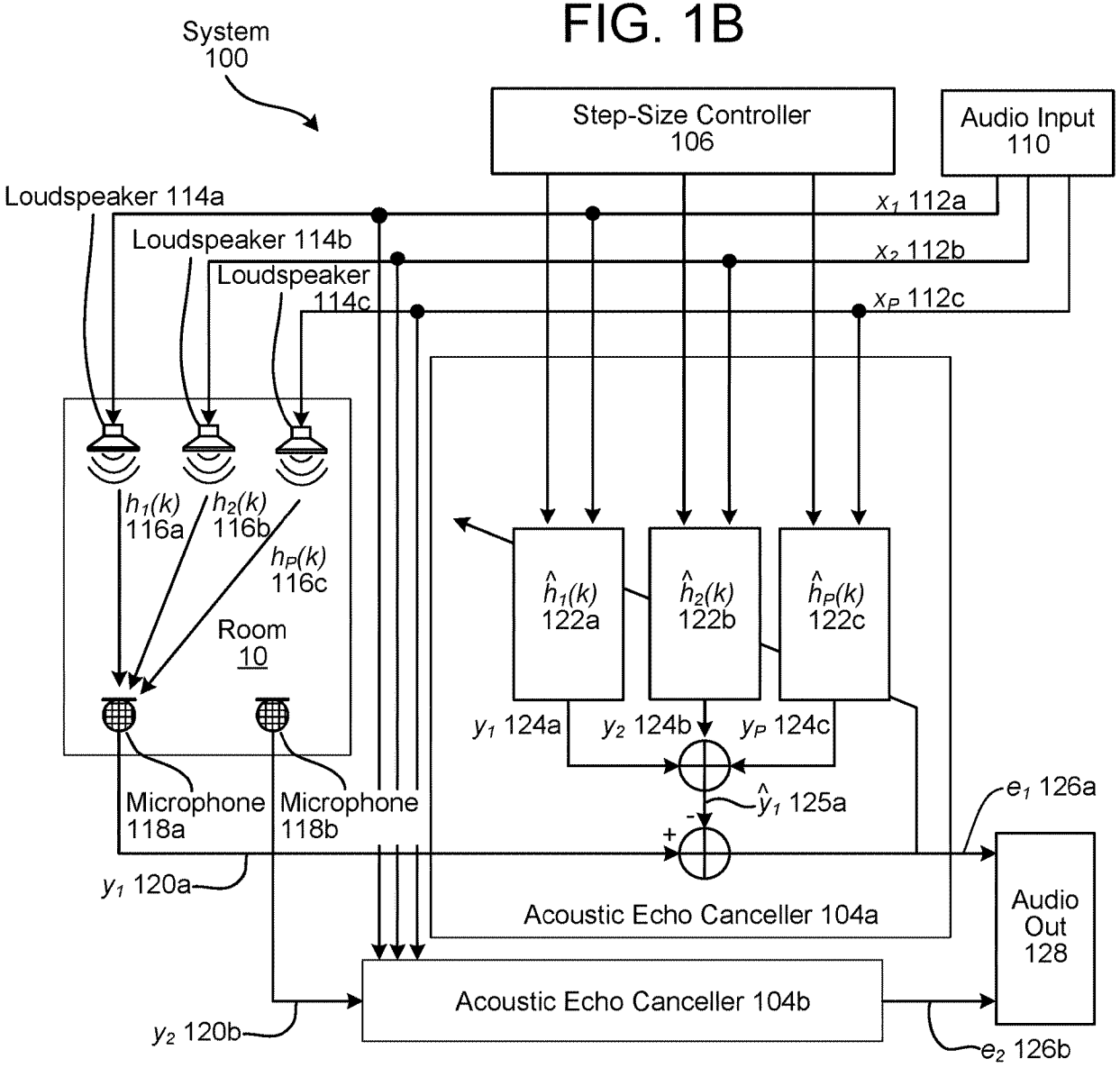
FIG. 1B illustrates an echo cancellation system that dynamically controls a step-size parameter according to embodiments of the present disclosure.

FIG. 1B illustrates a high-level conceptual block diagram of echo-cancellation aspects of a multi-channel acoustic echo cancellation (AEC) system 100 in a time domain. In some examples, the system 100 may comprise a device 102 that may include acoustic echo cancellers 104, such as a first acoustic echo canceller 104*a* and a second acoustic echo canceller 104*b*, and a step-size controller 106 that controls step-size parameters used by the acoustic echo cancellers 104. While FIG. 1B only illustrates two acoustic echo cancellers 104*a*/104*b*, the disclosure is not limited thereto and the number of acoustic echo cancellers 104 may correspond to the number of microphone signals 120 (e.g., microphone audio signals) without departing from the disclosure. While the following description refers only to the first acoustic echo canceller 104*a*, the concepts may be applied to any of the acoustic echo cancellers 104 without departing from the disclosure.

While not illustrated in FIG. 1B, the step-size controller 106 may receive playback signals 112 (e.g., 112*a*, 112*b*, 112*c*) (e.g., reference signals), microphone signal(s) 120 (e.g., 120*a*), estimated echo signals 124 (e.g., 124*a*, 124*b*, 124*c*), error signal(s) 126 (e.g., 126*a*), and/or other signals generated or used by the first acoustic echo canceller 104*a* and may determine step-size values and provide the step-size values to the first acoustic echo canceller 104*a* to be used by adaptive filters included in the first acoustic echo canceller 104*a*. The step-size values may be determined for individual channels (e.g., microphone signals 120) and/or tone indexes (e.g., frequency subbands) on a frame-by-frame basis. The first acoustic echo canceller 104*a* may use the step-size values to perform acoustic echo cancellation and generate a first error signal 126*a*, as will be discussed in greater detail below. Thus, the first acoustic echo canceller 104*a* may generate the first error signal 126*a* using first filter coefficients for the adaptive filters, the step-size controller 106 may use the playback signals 112 (e.g., 112*a*, 112*b*, 112*c*) (e.g., reference signals), the first error signal 126*a*, and/or other signals to determine a step-size value, and the adaptive filters may use the step-size value to generate second filter coefficients from the first filter coefficients.

As illustrated in FIG. 1B, an audio input 110 provides audio playback signals $x_1$(n) 112*a*, $x_2$(n) 112*b* and $x_P$(n) 112*c*, which may be referred to as reference signals 112 without departing from the disclosure. The number of reference signals 112 may correspond to a number of loudspeakers 114 associated with the system 100. For example, FIG. 1B illustrates an example in which a first reference signal $x_1$(n) 112*a* is transmitted to a first loudspeaker 114*a*, a second reference signal $x_2(n)$ 112*b* is transmitted to a second loudspeaker 114*b* and a third reference signal $x_P(n)$ 112*c* is transmitted to a third loudspeaker 114*c*. Each loudspeaker 114 may output the received audio, and portions of the output sounds are captured by microphones 118, illustrated in FIG. 1B as a pair of microphone 118*a*/118*b*. While FIG. 1B illustrates two microphones 118*a*/118*b*, the disclosure is not limited thereto and the system 100 may include any number of microphones 118 without departing from the present disclosure.

The portion of the sounds output by each of the loudspeakers 114*a*/114*b*/114*c* that reaches each of the microphones 118*a*/118*b* can be characterized based on transfer functions. FIG. 1B illustrates transfer functions $h_1(n)$ 116*a*, $h_2(n)$ 116*b* and $h_P(n)$ 116*c* between the loudspeakers 114*a*/114*b*/114*c* (respectively) and the microphone 118*a*. The transfer functions 116 vary with the relative positions of the components and the acoustics of the room 10. If the position of all of the objects in a room 10 are static, the transfer functions are likewise static. Conversely, if the position of an object in the room 10 changes, the transfer functions may change.

The transfer functions (e.g., 116*a*, 116*b*, 116*c*) characterize the acoustic "impulse response" of the room 10 relative to the individual components. The impulse response, or impulse response function, of the room 10 characterizes the signal from a microphone when presented with a brief input signal (e.g., an audible noise), called an impulse. The impulse response describes the reaction of the system as a function of time. If the impulse response between each of the loudspeakers 116*a*/116*b*/116*c* is known, and the content of the reference signals $x_1(n)$ 112*a*, $x_2(n)$ 112*b* and $x_P(n)$ 112*c* output by the loudspeakers is known, then the transfer functions 116*a*, 116*b* and 116*c* can be used to estimate the actual loudspeaker-reproduced sounds that will be received by a microphone (in this case, microphone 118*a*). The microphone 118*a* converts the captured sounds into a signal $y_1(n)$ 120*a*. A second set of transfer functions may be associated with the second microphone 118*b*, which converts captured sounds into a signal $y_2(n)$ 120*b*, although the disclosure is not limited thereto and additional sets of transfer functions may be associated with additional microphones 118 without departing from the disclosure.

The "echo" signal $y_1(n)$ 120*a* contains some of the reproduced sounds from the reference signals $x_1(n)$ 112*a*, $x_2(n)$ 112*b* and $x_P(n)$ 112*c*, in addition to any additional sounds picked up in the room 10. Thus, the echo signal $y_1(n)$ 120*a* can be expressed as:

$$y_1(n)=h_1(n)*x_1(n)+h_2(n)*x_2(n)+h_P(n)*x_P(n) \quad [5]$$

where $h_1(n)$ 116*a*, $h_2(n)$ 116*b* and $h_P(n)$ 116*c* are the loudspeaker-to-microphone impulse responses in the receiving room 10, $x_1(n)$ 112*a*, $x_2(n)$ 112*b* and $x_P(n)$ 112*c* are the loudspeaker reference signals, * denotes a mathematical convolution, and "n" is an audio sample.

The acoustic echo canceller 104*a* calculates estimated transfer functions 122*a*, 122*b* and 122*c*, each of which model an acoustic echo (e.g., impulse response) between an individual loudspeaker 114 and an individual microphone 118. For example, a first estimated transfer function $\hat{h}_1(n)$ 122*a* models a first transfer function $h_1(n)$ 116*a* between the first loudspeaker 114*a* and the first microphone 118*a*, a second estimated transfer function $\hat{h}_2$ (n) 122*b* models a second transfer function $h_2(n)$ 116*b* between the second loudspeaker 114*b* and the first microphone 118*a*, and a third estimated transfer function $\hat{h}_P$ (n) 122*c* models a third transfer function $h_P$ (n) 116*c* between the third loudspeaker 114*c* and the first microphone 118*a*. These estimated transfer functions $\hat{h}_1(n)$ 122*a*, $h_2$ (n) 122*b* and $\hat{h}_P$ (n) 122*c* are used to produce estimated echo signals $y_1(n)$ 124*a*, $y_2(n)$ 124*b* and $y_P(n)$ 124*c*, respectively.

To illustrate an example, the acoustic echo canceller 104*a* may convolve the reference signals 112 with the estimated transfer functions 122 (e.g., estimated impulse responses of the room 10) to generate the estimated echo signals 124. For example, the acoustic echo canceller 104*a* may convolve the first reference signal 112*a* by the first estimated transfer function $\hat{h}_1$ (n) 122*a* to generate the first estimated echo signal 124*a*, which models (e.g., represents) a first portion of the echo signal $y_1(n)$ 120*a*, may convolve the second reference signal 112*b* by the second estimated transfer function $\hat{h}_2$ (n) 122*b* to generate the second estimated echo signal 124*b*, which models (e.g., represents) a second portion of the echo signal $y_1(n)$ 120*a*, and may convolve the third reference signal 112*c* by the third estimated transfer function $\hat{h}_P(n)$ 122*c* to generate the third estimated echo signal 124*c*, which models (e.g., represents) a third portion of the echo signal $y_1(n)$ 120*a*.

The acoustic echo canceller 104*a* may determine the estimated echo signals 124 using adaptive filters, as discussed in greater detail below. For example, the adaptive filters may be normalized least means squared (NLMS) finite impulse response (FIR) adaptive filters that adaptively filter the reference signals 112 using filter coefficients. Thus, the first estimated transfer function $\hat{h}_1(n)$ 122*a* may correspond to a first adaptive filter that generates the first estimated echo signal 124*a* using a first plurality of adaptive filter coefficients, the second estimated transfer function $\hat{h}_2(n)$ 122*b* may correspond to a second adaptive filter that generates the second estimated echo signal 124*b* using a second plurality of adaptive filter coefficients, and the third estimated transfer function $\hat{h}_P(n)$ 122*c* may correspond to a third adaptive filter that generates the third estimated echo signal 124*c* using a third plurality of adaptive filter coefficients. The adaptive filters may update the adaptive filter coefficients over time, such that first adaptive filter coefficient values may correspond to the first adaptive filter and a first period of time, second adaptive filter coefficient values may correspond to the first adaptive filter and a second period of time, and so on.

The estimated echo signals 124 (e.g., 124*a*, 124*b* and 124*c*) may be combined to generate an estimated echo signal $\hat{y}_1(n)$ 125*a* corresponding to an estimate of the echo component in the echo signal $y_1(n)$ 120*a*. The estimated echo signal can be expressed as:

$$\hat{y}_1(n)=\hat{h}(k)*x_1(n)+\hat{h}_2(n)*x_2(n)+\hat{h}_P(n)*x_P(n) \quad [6]$$

where * again denotes convolution. Subtracting the estimated echo signal 125*a* from the echo signal 120*a* produces the first error signal $e_1(n)$ 126*a*. Specifically:

$$\hat{e}_1(n)=\hat{y}_1(n) \quad [7]$$

The system 100 may perform acoustic echo cancellation for each microphone 118 (e.g., 118*a* and 118*b*) to generate error signals 126 (e.g., 126*a* and 126*b*). Thus, the first acoustic echo canceller 104*a* corresponds to the first microphone 118*a* and generates a first error signal $e_1(n)$ 126*a*, the second acoustic echo canceller 104*b* corresponds to the second microphone 118*b* and generates a second error signal $e_2(n)$ 126*b*, and so on for each of the microphones 118. The first error signal $e_1(n)$ 126*a* and the second error signal $e_2(n)$ 126*b* (and additional error signals 126 for additional microphones) may be combined as an output (i.e., audio output 128). While FIG. 1B illustrates the first acoustic echo canceller 104*a* and the second acoustic echo canceller 104*b* as discrete components, the disclosure is not limited thereto and the first acoustic echo canceller 104*a* and the second acoustic echo canceller 104*b* may be included as part of a single acoustic echo canceller 104.

The acoustic echo canceller 104*a* may calculate frequency domain versions of the estimated transfer functions $\hat{h}_1(n)$ 122*a*, $\hat{h}_2$ (n) 122*b* and $\hat{h}_P$ (n) 122*c* using short term adaptive filter coefficients W(k,r) that are used by adaptive filters. In conventional AEC systems operating in the time domain, the adaptive filter coefficients are derived using least mean squares (LMS), normalized least mean squares (NLMS) or stochastic gradient algorithms, which use an instantaneous estimate of a gradient to update an adaptive weight vector at each time step. With this notation, the LMS algorithm can be iteratively expressed in the usual form:

$$h_{new}=h_{old}+\mu*e*x \quad [8]$$

where $h_{new}$ is an updated transfer function, $h_{old}$ is a transfer function from a prior iteration, μ is the step size between samples, e is an error signal, and x is a reference signal. For example, the first acoustic echo canceller 104*a* may generate the first error signal 126*a* using first filter coefficients for the adaptive filters (corresponding to a previous transfer function $h_{old}$), the step-size controller 106 may use the first error signal 126*a* to determine a step-size value (e.g., μ), and the adaptive filters may use the step-size value to generate second filter coefficients from the first filter coefficients (corresponding to a new transfer function $h_{new}$). Thus, the adjustment between the previous transfer function $h_{old}$ and new transfer function $h_{new}$ is proportional to the step-size value (e.g., μ). If the step-size value is closer to one or greater than one, the adjustment is larger, whereas if the step-size value is closer to zero, the adjustment is smaller.

Applying such adaptation over time (i.e., over a series of samples), it follows that the error signal "e" (e.g., 126*a*) should eventually converge to zero for a suitable choice of the step size μ (assuming that the sounds captured by the microphone 118*a* correspond to sound entirely based on the references signals 112*a*, 112*b* and 112*c* rather than additional ambient noises, such that the estimated echo signal $\hat{y}_1(n)$ 125*a* cancels out the echo signal $y_1(n)$ 120*a*). However, $e\rightarrow 0$ does not always imply that $h-\hat{h}\rightarrow 0$, where the estimated transfer function h cancelling the corresponding actual transfer function h is the goal of the adaptive filter. For example, the estimated transfer functions $\hat{h}$ may cancel a particular string of samples, but is unable to cancel all signals, e.g., if the string of samples has no energy at one or more frequencies. As a result, effective cancellation may be intermittent or transitory. Having the estimated transfer function $\hat{h}$ approximate the actual transfer function h is the goal of single-channel echo cancellation, and becomes even more critical in the case of multichannel echo cancellers that require estimation of multiple transfer functions.

In order to perform acoustic echo cancellation, the time domain input signal y(n) 120 and the time domain reference signal x(n) 112 may be adjusted to remove a propagation delay and align the input signal y(n) 120 with the reference signal x(n) 112. The system 100 may determine the propagation delay using techniques known to one of skill in the art and the input signal y(n) 120 is assumed to be aligned for the purposes of this disclosure. For example, the system 100 may identify a peak value in the reference signal x(n) 112, identify the peak value in the input signal y(n) 120 and may determine a propagation delay based on the peak values.

The acoustic echo canceller(s) 104 may use short-time Fourier transform-based frequency-domain acoustic echo cancellation (STFT AEC) to determine step-size. The following high level description of STFT AEC refers to echo signal y (120) which is a time-domain signal comprising an echo from at least one loudspeaker (114) and is the output of a microphone 118. The reference signal x (112) is a time-domain audio signal that is sent to and output by a loudspeaker (114). The variables X and Y correspond to a Short Time Fourier Transform of x and y respectively, and thus represent frequency-domain signals. A short-time Fourier transform (STFT) is a Fourier-related transform used to determine the sinusoidal frequency and phase content of local sections of a signal as it changes over time.

Using a Fourier transform, a sound wave such as music or human speech can be broken down into its component "tones" of different frequencies, each tone represented by a sine wave of a different amplitude and phase. Whereas a time-domain sound wave (e.g., a sinusoid) would ordinarily be represented by the amplitude of the wave over time, a frequency domain representation of that same waveform comprises a plurality of discrete amplitude values, where each amplitude value is for a different tone or "bin." So, for example, if the sound wave consisted solely of a pure sinusoidal 1 kHz tone, then the frequency domain representation would consist of a discrete amplitude spike in the bin containing 1 kHz, with the other bins at zero. In other words, each tone "m" is a frequency index.

Figure 2A:
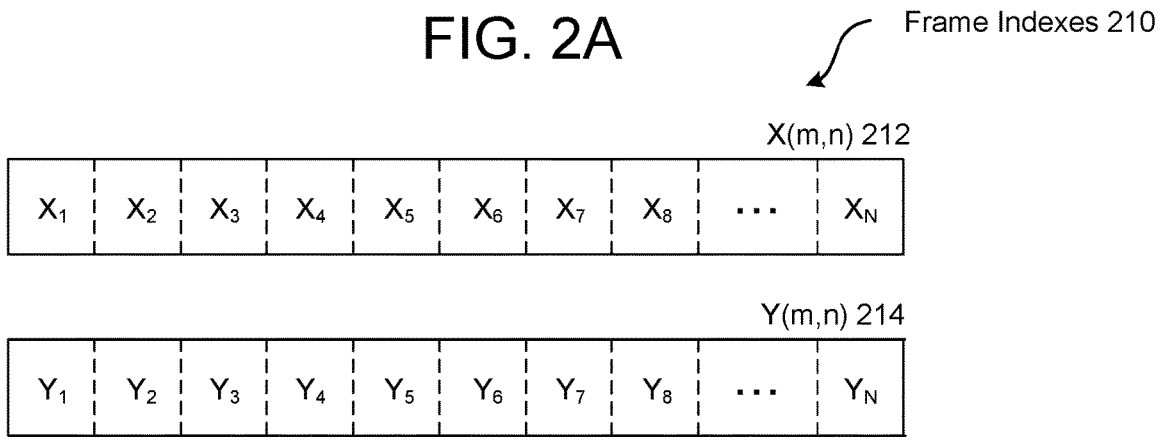
FIGS. 2A to 2C illustrate examples of channel indexes, tone indexes and frame indexes.

FIG. 2A illustrates an example of frame indexes 210 including reference values X(m,n) 212 and input values Y(m,n) 214. For example, the AEC 104 may apply a short-time Fourier transform (STFT) to the time-domain reference signal x(n) 112, producing the frequency-domain reference values X(m,n) 212, where the tone index "m" ranges from 0 to M and "n" is a frame index ranging from 0 to N. The AEC 104 may also apply an STFT to the time domain signal y(n) 120, producing frequency-domain input values Y(m,n) 214. As illustrated in FIG. 2A, the history of the values across iterations is provided by the frame index "n", which ranges from 1 to N and represents a series of samples over time.

Figure 2B:
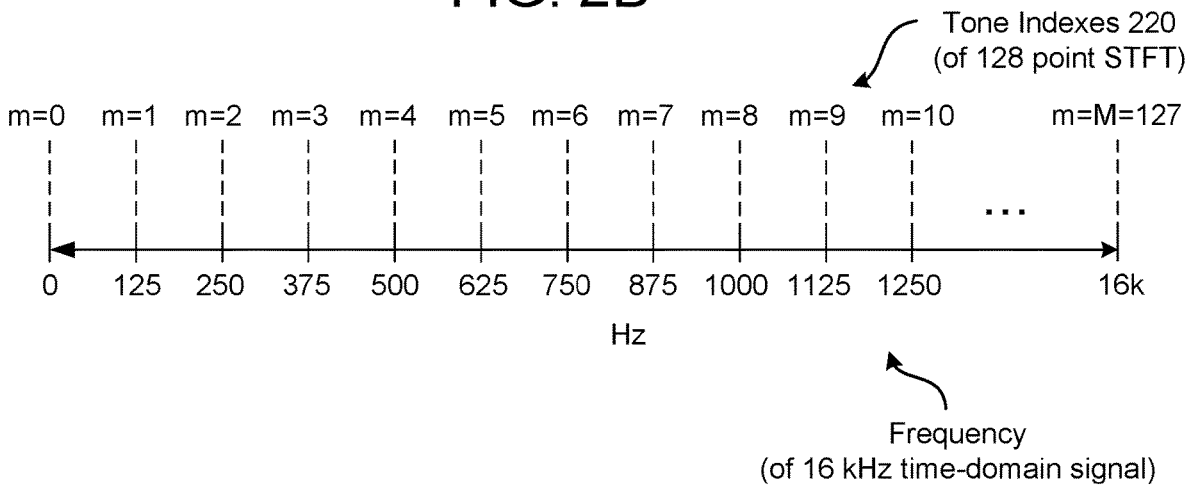
Figure 2C:
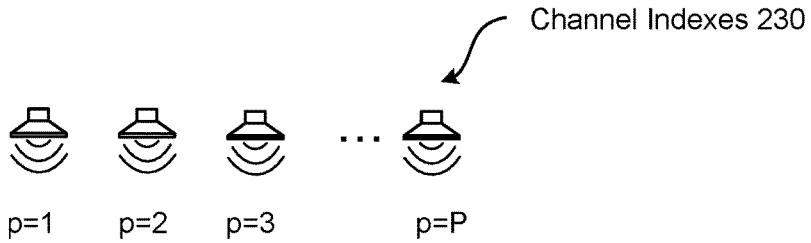

FIG. 2B illustrates an example of performing an M-point STFT on a time-domain signal. As illustrated in FIG. 2B, if a 128-point STFT is performed on a 16 kHz time-domain signal, the output is 128 complex numbers, where each complex number corresponds to a value at a frequency in increments of 16 kHz/128, such that there is 125 Hz between points, with point 0 corresponding to 0 Hz and point 127 corresponding to 16 kHz. As illustrated in FIG. 2B, each tone index 220 in the 128-point STFT corresponds to a frequency range (e.g., subband) in the 16 kHz time-domain signal. While FIG. 2B illustrates the frequency range being divided into 128 different subbands (e.g., tone indexes), the disclosure is not limited thereto and the system 100 may divide the frequency range into M different subbands without departing from the disclosure. While FIG. 2B illustrates the tone index 220 being generated using a Short-Time Fourier Transform (STFT), the disclosure is not limited thereto. Instead, the tone index 220 may be generated using Fast Fourier Transform (FFT), generalized Discrete Fourier Transform (DFT) and/or other transforms known to one of skill in the art (e.g., discrete cosine transform, non-uniform filter bank, etc.).

Given a signal z[n], the STFT Z(m,n) of z[n] is defined by $$Z(m,n)=\sum_{k=0}^{K-1} Win(k)*z(k+n*\mu)*e^{-2pi*m*k/K} \quad [9.1]$$

Where, Win(k) is a window function for analysis, m is a frequency index, n is a frame index, μ is a step-size (e.g., hop size), and K is an FFT size. Hence, for each block (at frame index n) of K samples, the STFT is performed which produces K complex tones X(m,n) corresponding to frequency index m and frame index n.

Referring to the input signal y(n) 120 from the microphone 118, Y(m,n) has a frequency domain STFT representation:

$$Y(m, n) = \sum_{k=0}^{K-1} Win(k) * y(k + n * \mu) * e^{-2pi*m*k/K} \quad [9.2]$$

Referring to the reference signal x(n) 112 to the loudspeaker 114, X(m,n) has a frequency domain STFT representation:

$$X(m, n) = \sum_{k=0}^{K-1} Win(k) * x(k + n * \mu) * e^{-2pi*m*k/K} \quad [9.3]$$

The system 100 may determine the number of tone indexes 220 and the step-size controller 106 may determine a step-size value for each tone index 220 (e.g., subband). Thus, the frequency-domain reference values X(m,n) 212 and the frequency-domain input values Y(m,n) 214 are used to determine individual step-size parameters for each tone index "m," generating individual step-size values on a frame-by-frame basis. For example, for a first frame index "1," the step-size controller 106 may determine a first step-size parameter μ(m) for a first tone index "m," a second step-size parameter μ(m+1) for a second tone index "m+1," a third step-size parameter μ(m+2) for a third tone index "m+2" and so on. The step-size controller 106 may determine updated step-size parameters for a second frame index "2," a third frame index "3," and so on.

As illustrated in FIG. 1B, the system 100 may be a multi-channel AEC, with a first channel p (e.g., reference signal 112*a*) corresponding to a first loudspeaker 114*a*, a second channel (p+1) (e.g., reference signal 112*b*) corresponding to a second loudspeaker 114*b*, and so on until a final channel (P) (e.g., reference signal 112*c*) that corresponds to loudspeaker 114*c*. FIG. 2A illustrates channel indexes 230 including a plurality of channels from channel p to channel P. Thus, while FIG. 1B illustrates three channels (e.g., reference signals 112), the disclosure is not limited thereto and the number of channels may vary. For the purposes of discussion, an example of system 100 includes "P" loudspeakers 114 (P>1) and a separate microphone array system (microphones 118) for hands free near-end/far-end multichannel AEC applications.

For each channel of the channel indexes (e.g., for each loudspeaker 114), the step-size controller 106 may perform the steps discussed above to determine a step-size value for each tone index 220 on a frame-by-frame basis. Thus, a first reference frame index 212*a* and a first input frame index 214*a* corresponding to a first channel may be used to determine a first plurality of step-size values, a second reference frame index 212*b* and a second input frame index 214*b* corresponding to a second channel may be used to determine a second plurality of step-size values, and so on. The step-size controller 106 may provide the step-size values to adaptive filters for updating filter coefficients used to perform the acoustic echo cancellation (AEC). For example, the first plurality of step-size values may be provided to first AEC 104*a*, the second plurality of step-size values may be provided to second AEC 104*b*, and so on. The first AEC 104*a* may use the first plurality of step-size values to update filter coefficients from previous filter coefficients, as discussed above with regard to Equation 4. For example, an adjustment between the previous transfer function $h_{old}$ and new transfer function $h_{new}$ is proportional to the step-size value (e.g., μ). If the step-size value is closer to one or greater than one, the adjustment is larger, whereas if the step-size value is closer to zero, the adjustment is smaller.

Calculating the step-size values for each channel/tone index/frame index allows the system 100 to improve steady-state error, reduce a sensitivity to local speech disturbance and improve a convergence rate of the AEC 104. For example, the step-size value may be increased when the error signal 126 increases (e.g., the echo signal 120 and the estimated echo signal 125 diverge) to increase a convergence rate and reduce a convergence period. Similarly, the step-size value may be decreased when the error signal 126 decreases (e.g., the echo signal 120 and the estimated echo signal 125 converge) to reduce a rate of change in the transfer functions and therefore more accurately estimate the estimated echo signal 125.

Figure 3:
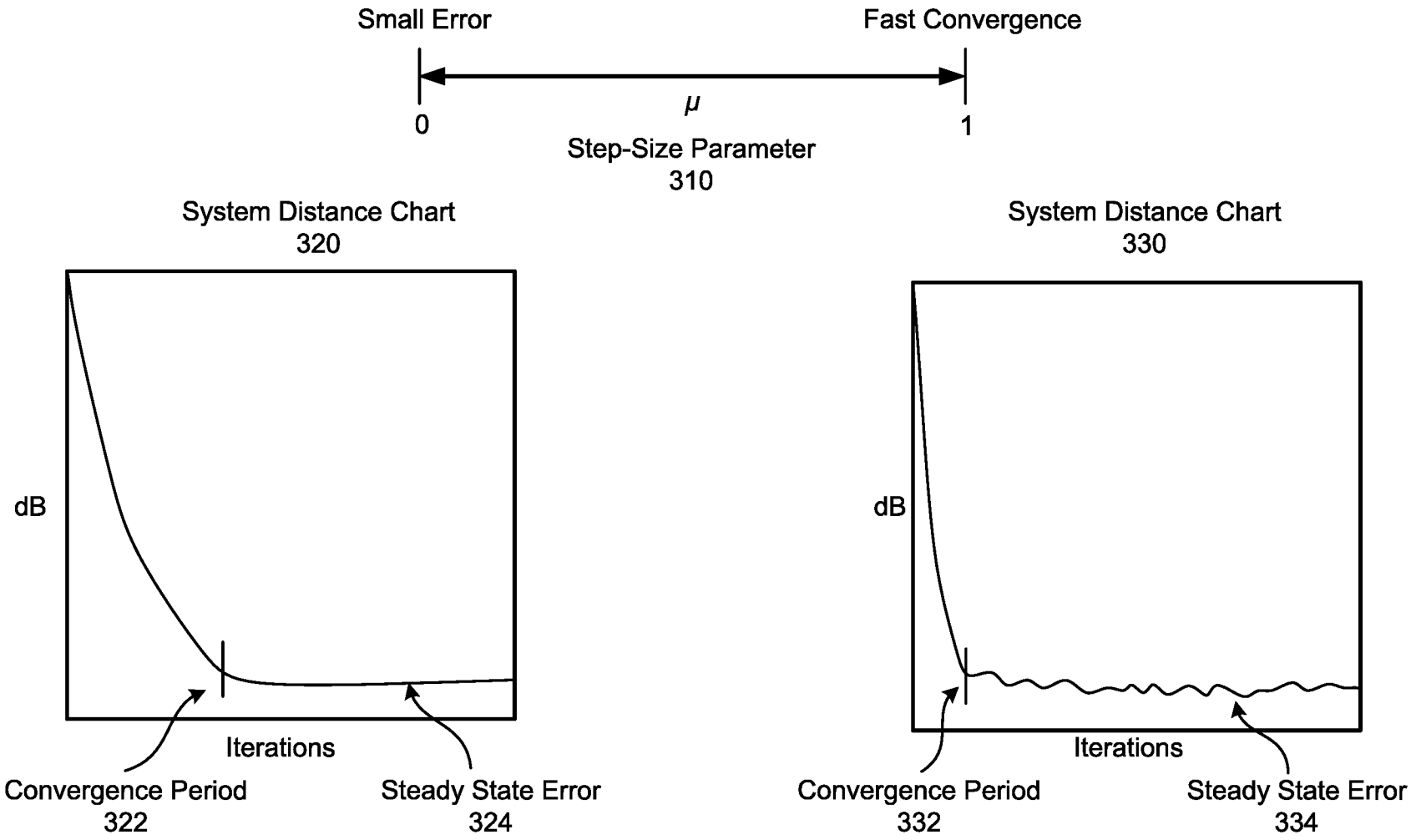
FIG. 3 illustrates examples of convergence periods and steady state error associated with different step-size parameters.

FIG. 3 illustrates examples of convergence periods and steady state error associated with different step-size parameters. As illustrated in FIG. 3, a step-size parameter 310 may vary between a lower bound (e.g., 0) and an upper bound (e.g., 1). A system distance measures the similarity between the estimated impulse response and the true impulse response. Thus, a relatively small step-size value corresponds to system distance chart 320, which has a relatively long convergence period 322 (e.g., time until the estimated echo signal 125 matches the echo signal 120) but relatively low steady state error 324 (e.g., the estimated echo signal 125 accurately estimates the echo signal 120). In contrast, a relatively large step-size value corresponds to system distance chart 330, which has a relatively short convergence period 332 and a relatively large steady state error 334. While the large step-size value quickly matches the estimated echo signal 125 to the echo signal 120, the large step-size value prevents the estimated echo signal 125 from accurately estimating the echo signal 120 over time due to misadjustments caused by noise sensitivity and/or near-end speech (e.g., speech from a speaker in proximity to the microphone 118).

Figure 4:
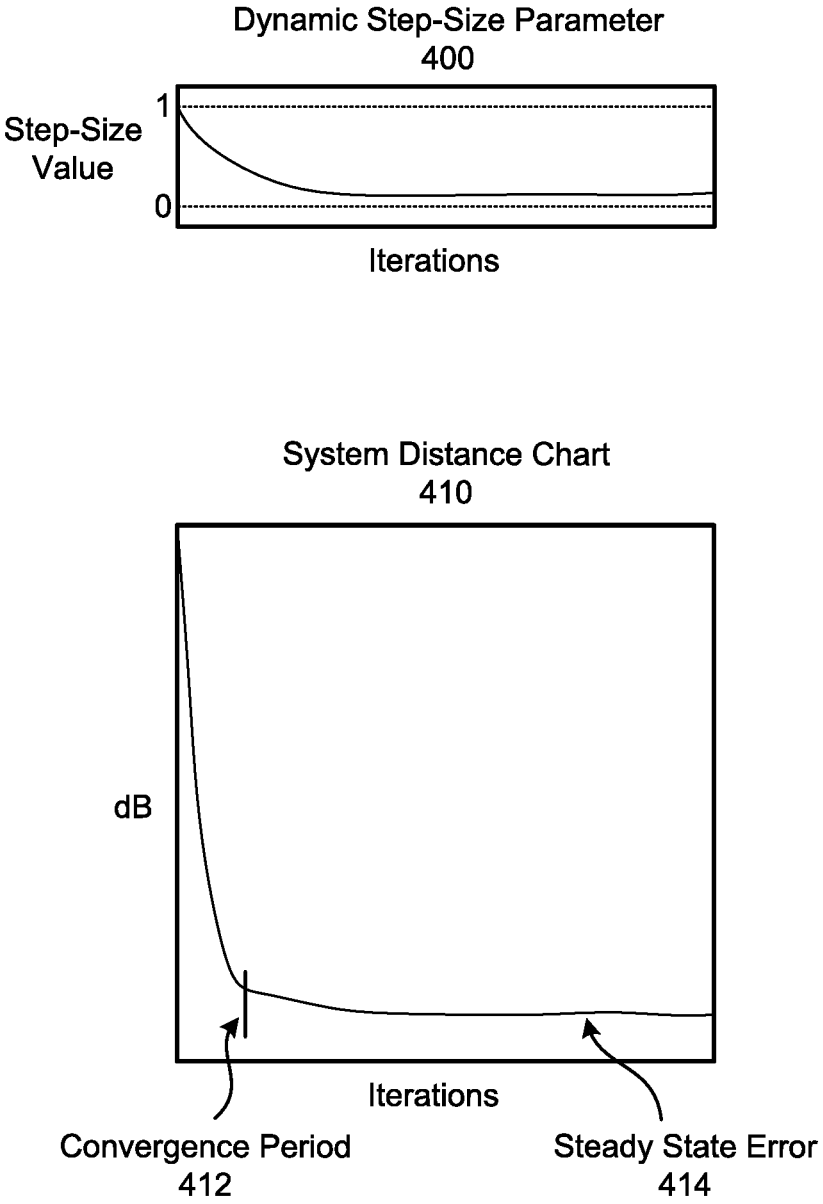
FIG. 4 illustrates an example of a convergence period and steady state error when a step-size parameter is controlled dynamically according to embodiments of the present disclosure.

FIG. 4 illustrates an example of a convergence period and steady state error when a step-size parameter is controlled dynamically according to embodiments of the present disclosure. As illustrated in FIG. 4, the system 100 may control a step-size value of a dynamic step-size parameter 400 over multiple iterations, ranging from an initial step-size value of one to improve convergence rate down to a smaller step-size value to prevent misadjustments. System distance chart 410 illustrates the effect of the dynamic step-size parameter 400, which has a relatively short convergence period 412 and relatively low steady state error 414.

While FIG. 4 illustrates a static environment where the system 100 controls the dynamic step-size parameter 400 from an initial state to a steady-state, a typical environment is dynamic and changes over time. For example, objects in the room 10 may move (e.g., a speaker may step in front of a loudspeaker 114 and/or microphone 118) and change an echo path, ambient noise (e.g., conversation levels, external noises or intermittent noises or the like) in the room 10 may vary and/or near-end speech (e.g., speech from a speaker in proximity to the microphone 118) may be present. The system 100 may dynamically control the step-size parameter to compensate for these fluctuations in environment and/or echo path.

For example, when the system 100 begins performing AEC, the system 100 may control step-size values to be large in order for the system 100 to learn quickly and match the estimated echo signal to the microphone signal (e.g., microphone audio signal). As the system 100 learns the impulse responses and/or transfer functions, the system 100 may reduce the step-size values in order to reduce the error signal and more accurately calculate the estimated echo signal so that the estimated echo signal matches the microphone signal. In the absence of an external signal (e.g., near-end speech), the system 100 may converge so that the estimated echo signal closely matches the microphone signal and the step-size values become very small. If the echo path changes (e.g., someone physically stands between a loudspeaker 114 and a microphone 118), the system 100 may increase the step-size values to learn the new acoustic echo. In the presence of an external signal (e.g., near-end speech), the system 100 may decrease the step-size values so that the estimated echo signal is determined based on previously learned impulse responses and/or transfer functions and the system 100 outputs the near-end speech.

Additionally or alternatively, the step-size values may be distributed in accordance with the reference signals 112. For example, if one channel (e.g., reference signal 112*a*) is significantly louder than the other channels, the system 100 may increase a step-size value associated with the reference signal 112*a* relative to step-size values associated with the remaining reference signals 112. Thus, a first step-size value corresponding to the reference signal 112*a* will be relatively larger than a second step-size value corresponding to the reference signal 112*b*.

Figure 5:
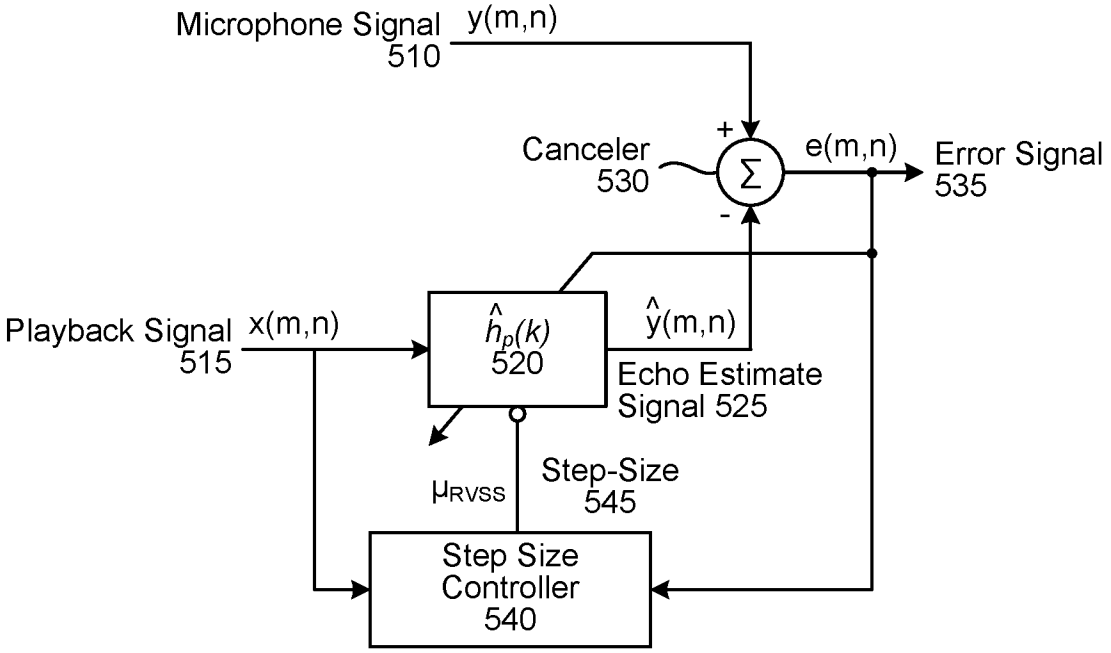
FIG. 5 illustrates an example component diagram for dynamically controlling a step-size parameter according to embodiments of the present disclosure.

FIG. 5 illustrates an example component diagram for dynamically controlling a step-size parameter according to embodiments of the present disclosure. As illustrated in FIG. 5, the system 100 may perform echo cancellation using a microphone signal 510 y(m, n) (e.g., microphone audio signal) and a playback signal 515 x(m, n) (e.g., reference audio signal). As described above, an estimated transfer function 520 $\hat{h}_p$ (k) may model or represent an acoustic echo (e.g., impulse response) between an individual loudspeaker 114 and an individual microphone 118. For example, the transfer function 520 $\hat{h}_p$ (k) may correspond to a first plurality of adaptive filter coefficient values associated with a first adaptive filter and the system 100 may use the first plurality of adaptive filter coefficient values to process the playback signal 515 x(m, n) and generate an echo estimate signal 525 ŷ(m, n). To perform echo cancellation, the system 100 may subtract the echo estimate signal 525 ŷ(m,n) from the microphone signal 510 y(m, n) to generate an error signal 535 e(m, n).

As illustrated in FIG. 5, the system 100 may perform echo cancellation in the subband domain, which helps the system 100 exert both time and frequency dependent adaptation controls. For example, the audio signals are represented in FIG. 5 with reference to a subband bin index m and a subband sample index n (e.g., x(m, n), y(m, n), ŷ(m, n), e(m, n)). However, the disclosure is not limited thereto and the system 100 may perform one or more steps associated with echo cancellation in the time domain (e.g., represented as x(n), y(n), ŷ(n), e (n)) and/or the frequency domain (e.g., represented as X(m, n), Ȳ(m, n), n), E(m, n)) without departing from the disclosure.

As the system 100 performs echo cancellation in the subband domain, the system 100 may determine the echo estimate signal 525 ŷ(m, n) using an adaptive filter coefficients weight vector:

$$\underline{w}_p(m,n) \triangleq [w_p^0(m,n) w_p^1(m,n) \ldots w_p^{L-1}(m,n)] \quad [10]$$

where p denotes a playback signal (e.g., reference signal 112), m denotes a subband bin index (e.g., frequency bin), n denotes a subband sample index, L denotes a length of the room impulse response (RIR), and $w_p^l$ (m, n) denotes a particular weight value at the pth channel for the mth subband, the nth sample, and the lth time step.

Using the adaptive filter coefficients weight vector $\underline{w}_p$(m, n), the system 100 may determine the echo estimate signal 525 ŷ(m, n) using the following equation:

$$\hat{y}_p(m, n) = \sum_{r=0}^{L-1} x_p(m, n-r) w_p^r(m, n) \quad [11]$$

where $\hat{y}_p$(m, n) is the echo estimate of the pth channel for the mth subband and nth subband sample, $x_p$ is the playback signal (e.g., reference signal) for the pth channel, and $w_p^r$(m, n) denotes the adaptive filter coefficients weight vector.

During conventional processing, the weight vector can be updated according to a subband normalized least mean squares (NLMS) algorithm:

$$\underline{w}_p(m, n) = \underline{w}_p(m, n-1) + \mu_p(m, n) \cdot \frac{\underline{x}_p(m, n)}{\|\underline{x}_p(m, n)\|^2 + \xi} \cdot e^*(m, n) \quad [12]$$

where $\underline{w}_p$(m, n) denotes an adaptive filter coefficients weight vector for the pth channel, mth subband, and nth sample, $\mu_p$ (m, n) denotes an adaptation step-size value, $\underline{x}_p$(m, n) denotes the playback signal 515 (e.g., reference signal) for the pth channel, ξ is a nominal value to avoid dividing by zero (e.g., regularization parameter), and e*(m, n) denotes a conjugate of the error signal 535 output by the canceller 530.

Using the equations described above, the system 100 may adapt the first adaptive filter by updating the first plurality of filter coefficient values to a second plurality of filter coefficient values using the error signal 535. For example, the system 100 may update the weight vector associated with the first adaptive filter using Equation [12] in order adjust the echo estimate signal 525 and minimize the error signal 535. Applying such adaptation over time (i.e., over a series of samples), it follows that the error signal 535 should eventually converge to zero for a suitable choice of the step size μ in the absence of ambient noises or near-end signals (e.g., all audible sounds captured by the microphone 118*a* corresponds to the playback signals 112). The rate at which the system 100 updates the first adaptive filter is proportional to the step-size value (e.g., μ). If the step-size value is closer to one or greater than one, the adjustment is larger, whereas if the step-size value is closer to zero, the adjustment is smaller.

When a near-end signal (e.g., near-end speech or other audible sound that doesn't correspond to the playback signals 112) is present, however, the system 100 should output the near-end signal, which requires that the system 100 not update the first adaptive filter quickly enough to cause the adaptive filter to diverge from a converged state (e.g., cancel the near-end signal). For example, the near-end signal may correspond to near-end speech, which is a desired signal and the system 100 may process the near-end speech and/or output the near-end speech to a remote system for speech processing or the like. Alternatively, the near-end signal may correspond to an impulsive noise, which is not a desired signal but passes quickly, such that adapting causes the echo cancellation to diverge from a steady state condition.

To improve echo cancellation, the system 100 may select a different cost function to model the near-end signal differently. As illustrated in FIG. 5, the system 100 may determine a step-size value 545$\mu_{RVSS}$ using a step size controller 540 according to embodiments of the present disclosure. For example, the system 100 may determine whether a near-end signal is present and either determine the step-size value 545 $\mu_{RVSS}$ using conventional techniques (e.g., when the near-end signal is not present) or determine the step-size value 545 $\mu_{RVSS}$ using a robust variable step-size (RVSS) algorithm as described in greater detail below. For example, the system 100 may determine that the near-end signal is present and determine the step-size value 545 $\mu_{RVSS}$ using the RVSS algorithm. Thus, the system 100 may select a different cost function used to update the adaptive filter coefficient values (e.g., weights), enabling the system 100 to better model the near-end disturbance statistics while the near-end signal is present. This may result in the system 100 selecting a lower step-size value, slowing a rate at which the adaptive filters update the plurality of filter coefficient values, although the disclosure is not limited thereto.

To stop the adaptive filter from diverging in the presence of a large near-end signal, the system 100 may constrain the filter update at each iteration:

$$\|\hat{w}_p(m,n)-\hat{w}_p(m,n-1)\|\leq\delta \quad [13.1]$$

where $\hat{w}_p$(m, n) denotes the RVSS weight vector (e.g., adaptive filter coefficients weight vector) for the pth channel, mth subband, and nth sample, $\hat{w}_p$(m, n−1) denotes the RVSS weight vector for a previous sample (n−1), and δ denotes a threshold parameter. The system 100 may select a fixed value of the threshold parameter δ for all subbands and/or samples, although the disclosure is not limited thereto and in some examples the system 100 may determine the threshold parameter individually for each subband and sample (e.g., $\delta_{m,n}$). The cost function is as follows:

$$\hat{w}_p(m,n)=\arg\min_{\hat{w}_p(m,n)} e(m,n)^2 \quad [13.2]$$

$$\text{s.t. } \|\hat{w}_p(m,n)-\hat{w}_p(m,n-1)\|^2\leq\delta$$

where $\hat{w}_p$ (m, n) denotes the RVSS weight vector (e.g., adaptive filter coefficients weight vector) for the pth channel, mth subband, and nth sample, e(m, n) denotes the posteriori error signal, $\hat{w}_p$(m, n−1) denotes the RVSS weight vector for a previous sample (n−1), and δ denotes a threshold parameter. The posteriori error signal may be defined as:

$$e(m,n)=(w_p(m,n)-\hat{w}_p(m,n))^H x_p(m,n) \quad [13.3]$$

where $x_p$ (m, n) denotes the playback signal 515 (e.g., reference signal) for the pth channel As illustrated in FIG. 5, the step size controller 540 may receive the playback signal 515 and the error signal 535 and may determine the step-size value 545 $\mu_{RVSS}$, which will be described in greater detail below with regard to FIGS. 6-8. The step size controller 540 may send the step-size value 545 $\mu_{RVSS}$ to the transfer function 520 (e.g., first adaptive filter) and the transfer function 520 may use the step-size value 545 $\mu_{RVSS}$ to control how quickly the first adaptive filter updates the plurality of filter coefficient values.

FIG. 6 illustrates examples of determining a step-size parameter according to embodiments of the present disclosure. As illustrated in FIG. 6, in some examples the system 100 may use a robust variable step-size (RVSS) weight vector 610, as shown below:

$$w_p(m,n)=\begin{cases} w_p(m,n-1)+\mu\cdot\dfrac{x_p(m,n)}{\|x_p(m,n)\|^2}\cdot e^*(m,n) & \text{if } \dfrac{|e(m,n)|}{\|x_p(m,n)\|}\leq\sqrt{\delta} \\ w_p(m,n-1)+\mu\cdot\sqrt{\delta}\cdot csgn(e(m,n))^*\cdot\dfrac{x_p(m,n)}{\|x_p(m,n)\|} & \text{if } \dfrac{|e(m,n)|}{\|x_p(m,n)\|}>\sqrt{\delta} \end{cases} \quad [14]$$

where $w_p$(m, n) denotes the RVSS weight vector (e.g., adaptive filter coefficients weight vector) for the pth channel, mth subband, and nth sample, μ denotes an adaptation step-size value, $x_p$ (m, n) denotes the playback signal 515 (e.g., reference signal) for the pth channel, $\|x_p(m,n)\|$ denotes a vector norm (e.g., vector length, such as a Euclidian norm) associated with the playback signal 515, e*(m, n) denotes a conjugate of the error signal 535 output by the canceller 530, $|e_p$ (m, n)| denotes an absolute value of the error signal 535, $\sqrt{\delta}$ denotes a threshold value (e.g., square root of a threshold parameter δ), and csgn( ) denotes a complex sign function (e.g., the sign of a complex number z is defined as z/|z|).

Thus, when the scaled error $$\frac{|e(m,n)|}{\|x_p(m,n)\|}$$

is less than or equal to the threshold value $\sqrt{\delta}$, the system 100 may update the weight vector using the NLMS algorithm described above with regard to Equation [12], whereas when the scaled error $$\frac{|e(m,n)|}{\|x_p(m,n)\|}$$

is greater than the threshold value $\sqrt{\delta}$, the system 100 may update the weight vector using the RVSS algorithm. This results in an algorithm that switches between minimizing one of two cost functions depending on the current near-end conditions; an $\ell_2$ norm when the near-end signal is not present, resulting in the usual NLMS update, or an $\ell_1$ norm when the near-end signal is present, resulting in a normalized sign update that is robust.

In some examples, this can be expressed in terms of a robust variable step-size (RVSS) value 620:

$$\mu_{RVSS}=\min\left[\sqrt{\delta}\cdot\frac{\|x_p(m,n)\|}{|e(m,n)|},1\right] \quad [15]$$

where $\mu_{RVSS}$ is the adaptation step-size (e.g., RVSS value 620) for the pth channel, mth subband, and nth sample, $\sqrt{\delta}$ denotes the threshold value described above (e.g., square root of a threshold parameter δ), $\|x_p(m, n)\|$ denotes a vector norm (e.g., vector length, such as a Euclidian norm) associated with the playback signal 515, and $|e(m, n)|$ denotes an absolute value of the error signal 535. Thus, the RVSS value 620 may vary based on the threshold value $\sqrt{\delta}$ and the inverse of the scaled error $$\frac{\|x_p(m, n)\|}{|e(m, n)|},$$

but Equation [15] prevents it from ever exceeding a maximum value of one.

Using the RVSS value above, the RVSS weight vector 630 may be represented as:

$$w_p(m, n) = w_p(m, n-1) + \mu_{RVSS} \cdot \mu_{fixed} \cdot \frac{x_p(m, n)}{\|x_p(m, n)\|^2} \cdot e^*(m, n) \quad [16]$$

where $w_p(m, n)$ denotes the RVSS weight vector (e.g., adaptive filter coefficients weight vector) for the pth channel, mth subband, and nth sample, $\mu_{RVSS}$ denotes the RVSS adaptation step-size value, $\mu_{fixed}$ denotes a fixed adaptation step-size value, $x_p(m, n)$ denotes the playback signal 515 (e.g., reference signal) for the pth channel, $\|x_p(m, n)\|$ denotes a vector norm (e.g., vector length, such as a Euclidian norm) associated with the playback signal 515, and $e^*(m, n)$ denotes a conjugate of the error signal 535 output by the canceller 530.

Figure 7:
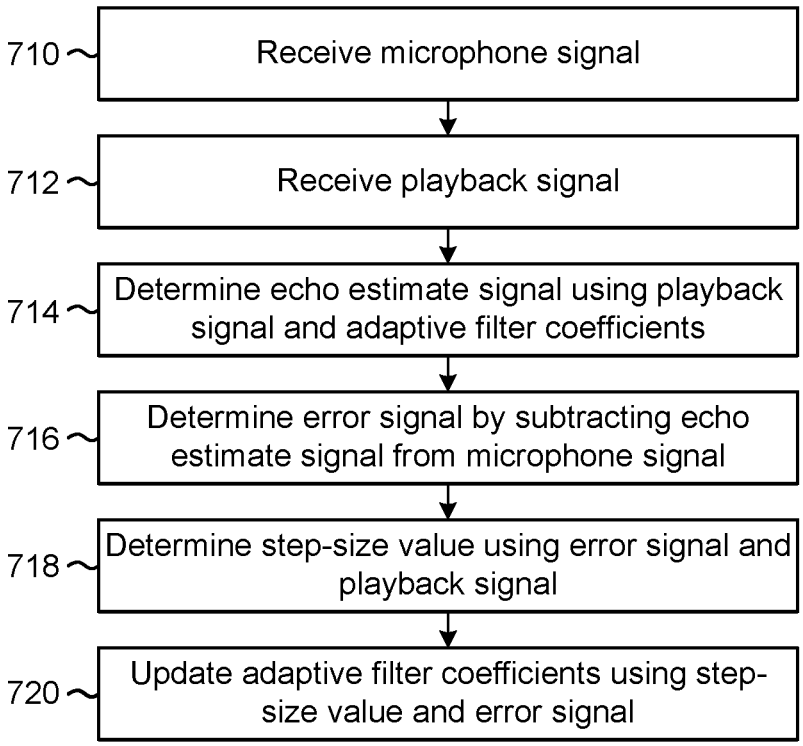
FIG. 7 is a flowchart conceptually illustrating an example method for dynamically controlling a step-size parameter according to embodiments of the present disclosure.

FIG. 7 is a flowchart conceptually illustrating an example method for dynamically controlling a step-size parameter according to embodiments of the present disclosure. As illustrated in FIG. 7, the system 100 may receive (710) a microphone signal, may receive (712) a playback signal, may determine (714) an echo estimate signal using the playback signal and adaptive filter coefficient values of an adaptive filter, and may determine (716) an error signal by subtracting the echo estimate signal from the microphone signal, as described in greater detail above with regard to FIG. 5.

The system 100 may determine (718) a step-size value using the error signal and the playback signal, as described above with regard to FIG. 6, and may update (720) the adaptive filter coefficient values using the step-size value and the error signal.

Figure 8:
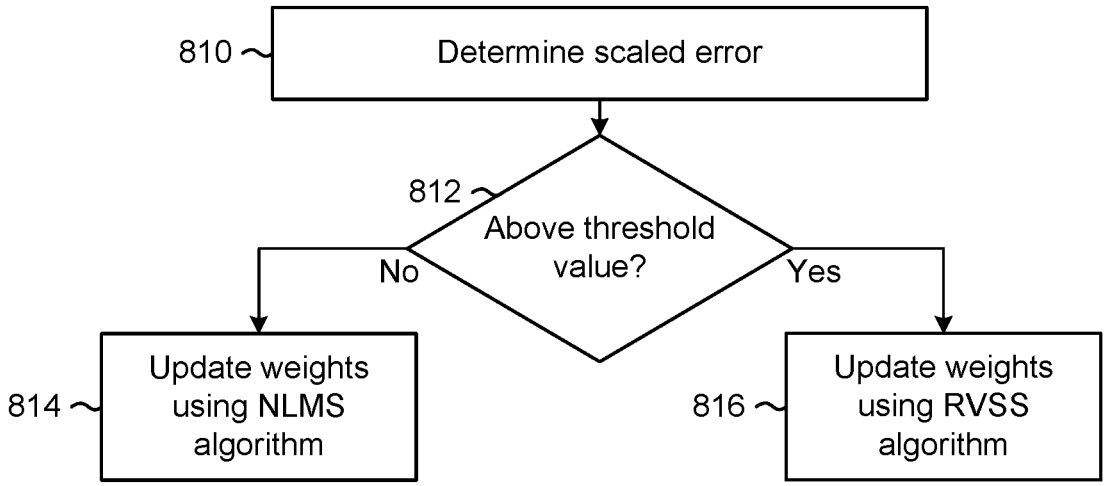
FIG. 8 is a flowchart conceptually illustrating an example method for determining when to update filter coefficients using a robust variable step size according to embodiments of the present disclosure.

FIG. 8 is a flowchart conceptually illustrating an example method for determining when to update filter coefficients using a robust variable step size according to embodiments of the present disclosure. As illustrated in FIG. 8, the system 100 may determine (810) a scaled error $$\left(\text{e.g., } \frac{\|x_p(m, n)\|}{|e(m, n)|}\right)$$

and determine (812) whether the scaled error is above a threshold value. As described above with regard to FIG. 6, if the scaled error is less than or equal to the threshold value $\sqrt{\delta}$, the system 100 may update (814) weights using a normalized least means squared (NLMS) algorithm described above and illustrated in Equation [14]. If the scaled error is greater than the threshold value $\sqrt{\delta}$, the system 100 may update (816) weights using the robust variable step-size (RVSS) algorithm described above and illustrated in Equation [14].

FIG. 9 illustrates examples of performing cost function selection according to embodiments of the present disclosure. As described above, the system 100 may compare the scaled error $$\left(\text{e.g., } \frac{\|x_p(m, n)\|}{|e(m, n)|}\right)$$

to a threshold value $\sqrt{\delta}$ (e.g., square root of a threshold parameter δ) to determine whether to apply the NLMS algorithm or the RVSS algorithm to determine a step-size parameter used to update the adaptive filters. In the examples described above, the threshold value $\sqrt{\delta}$ may be a fixed value that is predetermined for the system 100 and used during echo cancellation regardless of system conditions.

In some examples, however, the system 100 may dynamically determine the threshold value $\sqrt{\delta}$ by controlling the threshold parameter δ. For example, the system 100 may initialize the threshold parameter δ to a higher value and then let it decay to a minimum value. This enables the system 100 to converge faster initially due to less constraints. The threshold parameter δ thus becomes time and frequency dependent, which may be represented as threshold parameter $\delta_{m,n}$.

To control when the threshold value $\sqrt{\delta}$ is modified, the system 100 may dynamically determine the threshold parameter $\delta_{m,n}$ when an update condition 910 is satisfied. As illustrated in FIG. 9, the update condition 910 corresponds to:

$$\frac{e(m, n)^2}{\|x_p(m, n)\|^2} < \delta \quad [17]$$

where $e_p(m, n)^2$ denotes a square of the error signal 535, $\|x_p(m,n)\|^2$, denotes a square of the vector norm (e.g., vector length, such as a Euclidian norm) associated with the playback signal 515, and δ represents a fixed value.

When the update condition 910 is satisfied, the system 100 may determine the threshold parameter $\delta_{k,m}$ 920 using the following equation:

$$\delta_{m,n} = \lambda\delta_{m,n-1} + (1-\lambda)\min\left(\delta_{m,n-1}, \frac{e(m, n)^2}{\|x_p(m, n)\|^2}\right) \quad [18]$$

where $\delta_{m,n}$ denotes the threshold parameter used to determine the threshold value for the mth subband and nth sample, λ denotes a smoothing parameter having a value between zero and 1 (e.g., $0<\lambda<1$), $e(m, n)^2$ denotes a square of the error signal 535, and $\|x_p(m, n)\|^2$ denotes a square of the vector norm (e.g., vector length, such as a Euclidian norm) associated with the playback signal 515.

To avoid losing tracking capabilities, the system 100 may limit the threshold parameter $\delta_{m,n}$ to a minimum function 930, as shown below:

$$\delta_{m,n} = \max(\delta_{m,n}, \delta_{min}) \quad [19]$$

Thus, the threshold parameter $\delta_{m,n}$ is determined using Equation [18] or set equal to a minimum value (e.g., $\delta_{min}$). As the system 100 uses the threshold parameter $\delta_{m,n}$ to determine whether to use the NLMS algorithm or the RVSS algorithm (e.g., perform cost function selection), increasing the threshold parameter $\delta_{m,n}$ increases the threshold value $\sqrt{\delta}$, increasing a likelihood that the system 100 uses the NLMS algorithm to select step-size values. As the NLMS algorithm determines step-size values that are higher than the RVSS algorithm, increasing the threshold parameter $\delta_{m,n}$ increases the step-size values and therefore enables the system 100 to converge more rapidly.

Figure 10:
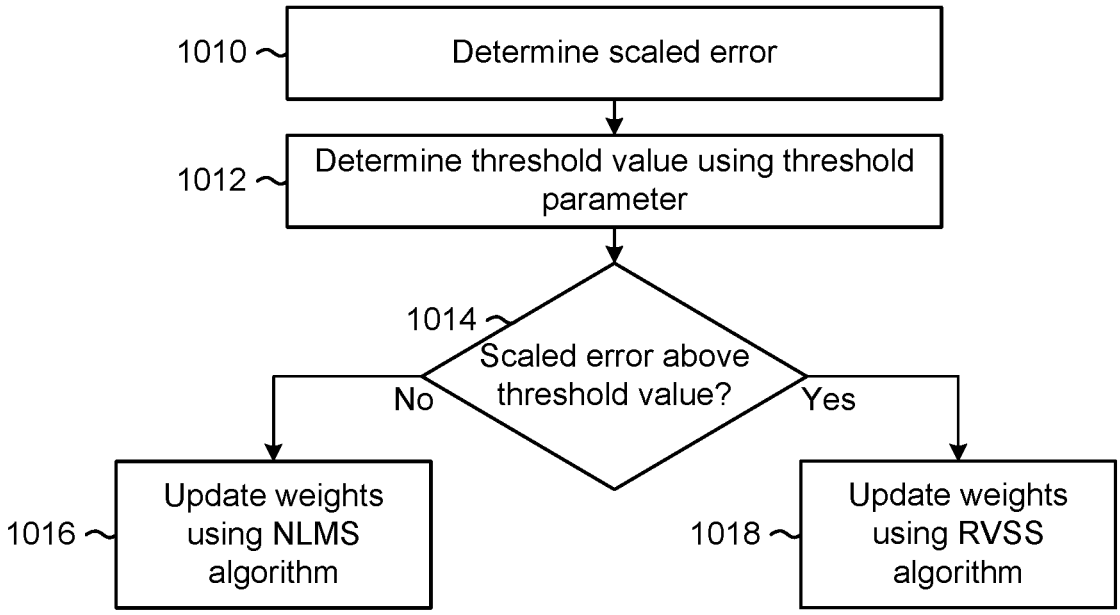
FIG. 10 is a flowchart conceptually illustrating an example method for determining when to update filter coefficient using a robust variable step size according to embodiments of the present disclosure.

FIG. 10 is a flowchart conceptually illustrating an example method for determining when to update filter coefficient using a robust variable step size according to embodiments of the present disclosure. As illustrated in FIG. 10, the system 100 may determine (1010) a scaled error $$\left(\text{e.g., } \frac{\|x_p(m, n)\|}{|e(m, n)|}\right),$$

determine (1012) a threshold value using a threshold parameter ($\delta_{m,n}$ as described above with regard to Equations [17]-[19], and determine (1014) whether the scaled error is above the threshold value. As described above with regard to FIG. 6, if the scaled error is less than or equal to the threshold value, the system 100 may update (1016) weights using a normalized least means squared (NLMS) algorithm described above and illustrated in Equation [14]. If the scaled error is greater than the threshold value, the system 100 may update (1018) weights using the robust variable step-size (RVSS) algorithm described above and illustrated in Equation [14].

Figure 11:
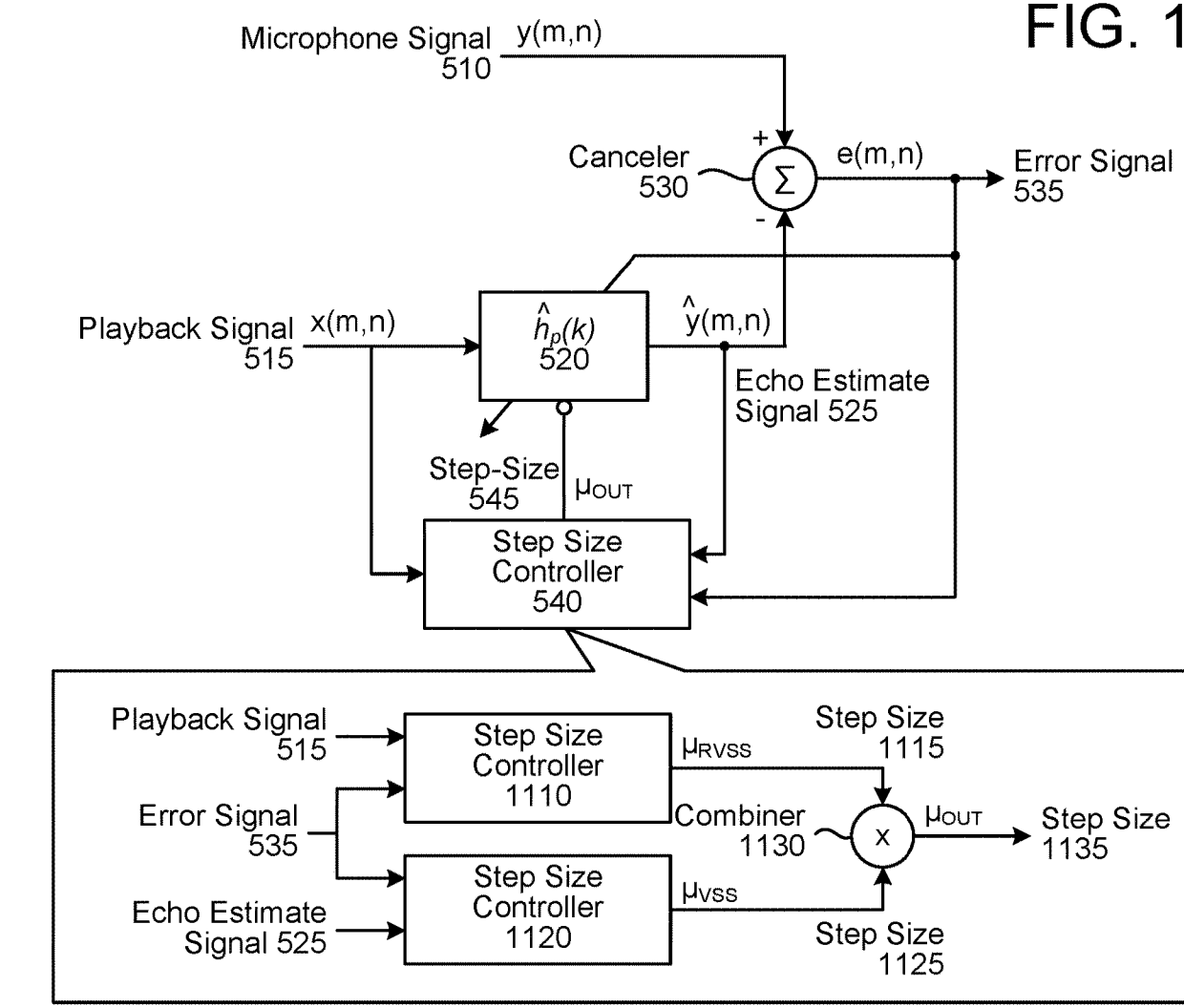
FIG. 11 illustrates an example component diagram for combining a robust variable step-size parameter with a variable step-size parameter according to embodiments of the present disclosure.

FIG. 11 illustrates an example component diagram for combining a robust variable step-size parameter with a variable step-size parameter according to embodiments of the present disclosure. As the components illustrated in FIG. 11 are identical to those described above with regard to FIG. 5, a redundant description is omitted. However, the example illustrated in FIG. 11 departs from the example illustrated in FIG. 5 with regard to how the step size controller 540 determines a step-size value. For example, the example illustrated in FIG. 11 generates the RVSS step-size value described above with regard to FIG. 5, but then combines the RVSS step-size value with a second step-size value to generate a step-size value 545 $\mu_{OUT}$.

As illustrated in FIG. 11, a first step size controller 1110 may receive the playback signal 515 and the error signal 535 and generate a first step-size value 1115 $\mu_{RVSS}$ using the robust variable step-size (RVSS) algorithm, as described in greater detail above with regard to FIG. 6. In addition, a second step size controller 1120 may receive the error signal 535 and the echo estimate signal 525 and generate a second step-size value 1125 $\mu_{VSS}$ using a variable step-size algorithm (VSS). For example, the VSS algorithm may dynamically determine a variable step-size value using techniques known to one of skill in the art. In some examples, the VSS algorithm may determine the second step-size value 1125 using a normalized squared cross-correlation (NSCC) between the error signal 535 and the estimate echo signal 525, although the disclosure is not limited thereto. As used herein, the VSS algorithm may refer to any known technique for dynamically generating a variable step-size value.

Instead of simply determining the variable step-size value using the VSS algorithm and then using the variable step-size value to update the adaptive filters, FIG. 11 illustrates that the system 100 may generate an output step-size value using the first step-size value 1115 $\mu_{RVSS}$ and the second step-size value 1125 $\mu_{VSS}$. For example, the system 100 may generate a third step-size value 1135 $\mu_{OUT}$ by multiplying the first step-size value 1115 $\mu_{RVSS}$ and the second step-size value 1125 $\mu_{VSS}$ using a combiner 1130. Thus, the first step-size value 1115 $\mu_{RVSS}$ generated by the RVSS algorithm may modify the second step-size value 1125 $\mu_{VSS}$ generated by the VSS algorithm to reduce a rate at which the adaptive filters update when near-end signals are detected. For example, when the near-end signal is not detected, the first step-size value 1115 $\mu_{RVSS}$ may be equal to a value of one, resulting in the third step-size value 1135 $\mu_{OUT}$ being equal to the second step-size value 1125 vss. However, when a near-end signal is detected, the first step-size value 1115 $\mu_{RVSS}$ may have a value between zero and one, resulting in the third step-size value 1135 $\mu_{OUT}$ being smaller than the second step-size value 1125 $\mu_{VSS}$.

Using the first step-size value 1115 $\mu_{RVSS}$ and the second step-size value 1125 $\mu_{VSS}$, the system 100 may generate a RVSS weight vector 1140:

$$w_p(m, n) = w_p(m, n-1) + \mu_{RVSS} \cdot \mu_{VSS} \cdot \frac{x_p(m, n)}{\|x_p(m, n)\|^2} \cdot e^*(m, n) \quad [20]$$

where $w_p(m, n)$ denotes the RVSS weight vector (e.g., adaptive filter coefficients weight vector) for the pth channel, mth subband, and nth sample, $\mu_{RVSS}$ denotes the robust variable adaptation step-size value generated using the RVSS algorithm, $\mu_{VSS}$ denotes a variable adaptation step-size value generated using the VSS algorithm, $x_p(m, n)$ denotes the playback signal 515 (e.g., reference signal) for the pth channel, $\|x_p(m, n)\|$ denotes a vector norm (e.g., vector length, such as a Euclidian norm) associated with the playback signal 515, and $e^*(m, n)$ denotes a conjugate of the error signal 535 output by the canceller 530.

Figure 12:
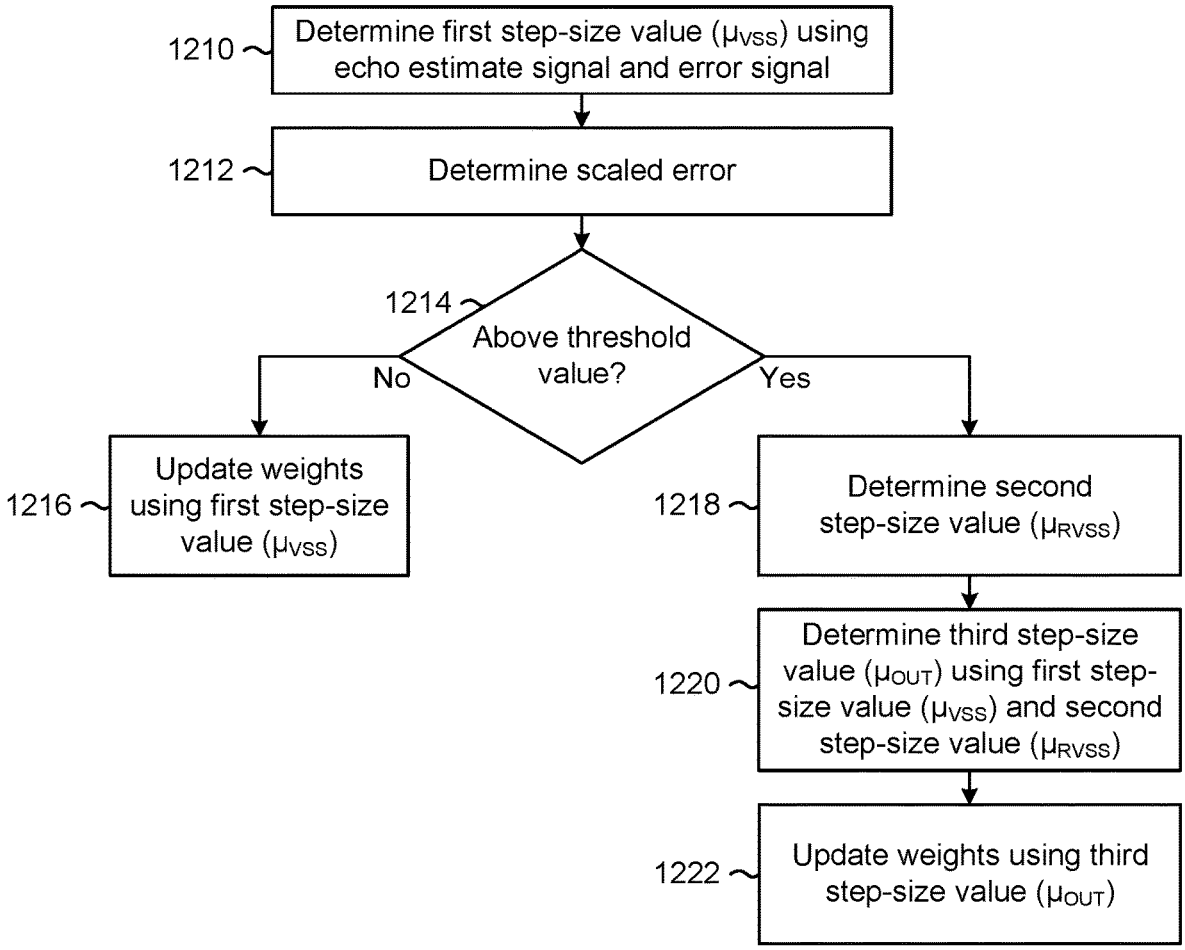
FIG. 12 is a flowchart conceptually illustrating an example method for determining when to use a robust variable step size according to embodiments of the present disclosure.

FIG. 12 is a flowchart conceptually illustrating an example method for determining when to use a robust variable step size according to embodiments of the present disclosure. As illustrated in FIG. 12, the system 100 may determine (1210) a first step-size value $\mu_{VSS}$ using an echo estimate signal and an error signal, determine (1212) a scaled error $$\left(\text{e.g., } \frac{\|x_p(m, n)\|}{|e(m, n)|}\right),$$

and determine (1214) whether the scaled error is above a threshold value.

If the scaled error is less than or equal to the threshold value, the system 100 may update (1216) weights using the first step-size value $\mu_{VSS}$. If the scaled error is greater than the threshold value, the system 100 may determine (1218) a second step-size value $\mu_{RVSS}$, may determine (1220) a third step-size value $\mu_{OUT}$ using the first step-size value $\mu_{VSS}$ and the second step-size value $\mu_{RVSS}$, and may update (1222) weights using the third step-size value $\mu_{OUT}$.

Figure 13:
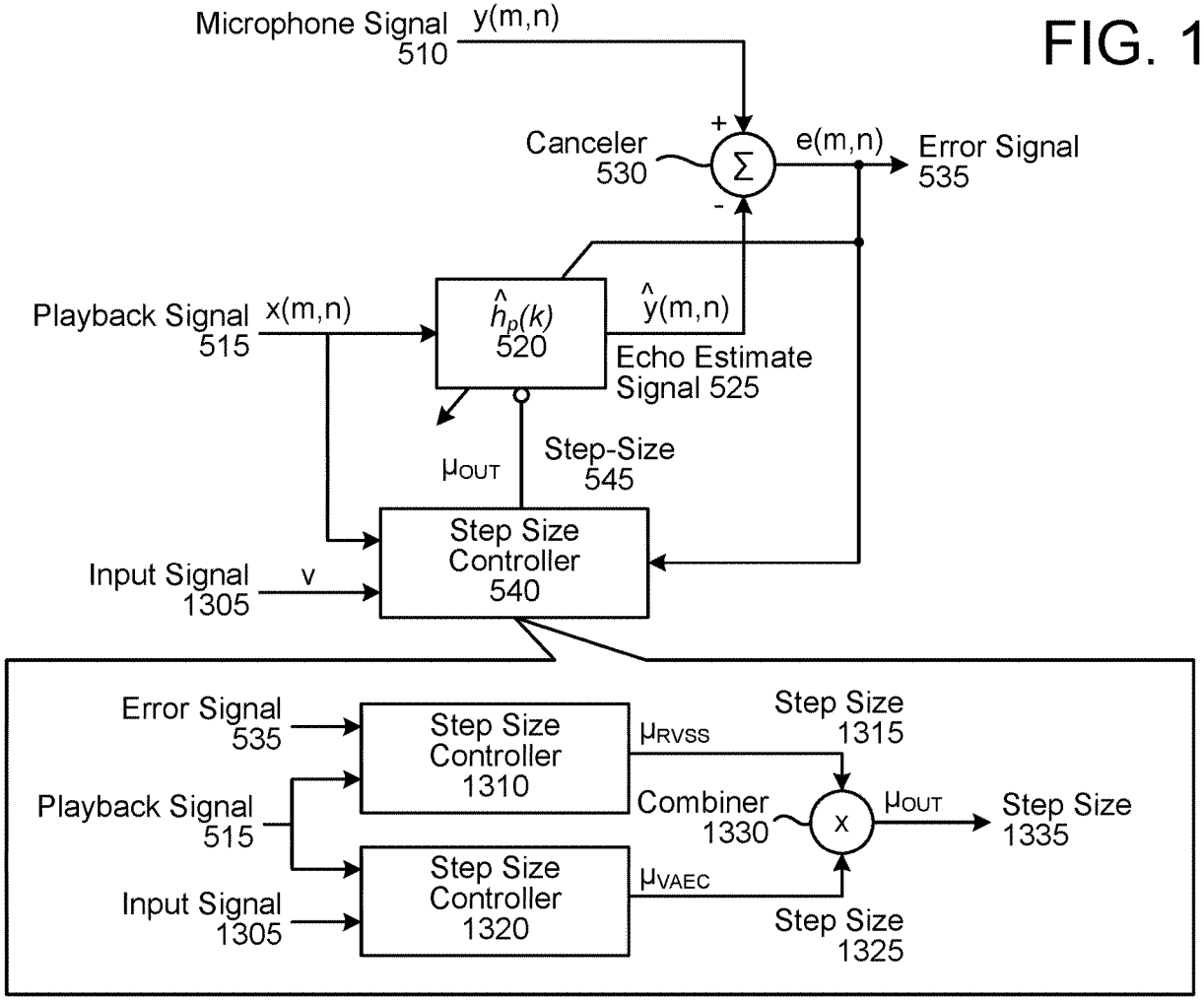
FIG. 13 illustrates an example component diagram for combining a robust variable step-size parameter with a velocity step-size parameter according to embodiments of the present disclosure.

FIG. 13 illustrates an example component diagram for combining a robust variable step-size parameter with a velocity step-size parameter according to embodiments of the present disclosure. As the components illustrated in FIG. 13 are identical to those described above with regard to FIG. 5, a redundant description is omitted. However, the example illustrated in FIG. 13 departs from the example illustrated in FIG. 5 with regard to how the step size controller 540 determines a step-size value. For example, the example illustrated in FIG. 13 generates the RVSS step-size value described above with regard to FIG. 5, but then combines the RVSS step-size value with a second step-size value to generate a step-size value 545 $\mu_{OUT}$.

As illustrated in FIG. 13, a first step size controller 1310 may receive the playback signal 515 and the error signal 535 and generate a first step-size value 1315 $\mu_{RVSS}$ using the robust variable step-size (RVSS) algorithm, as described in greater detail above with regard to FIG. 6. In addition, a second step size controller 1320 may receive the playback signal 515 and an input signal 1305 ν (e.g., velocity signal or motion information) and generate a second step-size value 1325 $\mu_{VAEC}$ using a velocity-based step-size algorithm. For example, when the device 102 is a motile device and the input signal 1305 indicates a velocity of the device 102, the velocity-based algorithm may dynamically determine a variable step-size value based on the velocity of the device 102. Thus, when the velocity increases, the velocity-based algorithm may generate faster step-sizes to enable the system 100 to quickly adapt to a new environment, changes to an echo path, and/or changing impulse responses. As used herein, the velocity-based algorithm may refer to any technique for dynamically generating a variable step-size value based on a velocity of the device 102.

When the motile device is in motion, the device may create audible sounds (e.g., vibrations, rattling, road noise, etc.) that may disturb the adaptive filter coefficients. For example, the audible sounds may vary over time and be inconsistent, preventing the adaptive filter coefficients from cancelling this noise while also causing the adaptive filter to diverge. Instead of simply determining the second step-size value 1325 $\mu_{VAEC}$ using the velocity-based step-size algorithm and then using the second step-size value 1325 $\mu_{VAEC}$ to update the adaptive filters, FIG. 13 illustrates that the system 100 may generate an output step-size value using the first step-size value 1315 $\mu_{RVSS}$ and the second step-size value 1325 $\mu_{VAEC}$. For example, the system 100 may generate a third step-size value 1335 $\mu_{OUT}$ by multiplying the first step-size value 1315 $\mu_{RVSS}$ and the second step-size value 1325 $\mu_{VAEC}$ using a combiner 1330. Thus, the first step-size value 1315 $\mu_{RVSS}$ generated by the RVSS algorithm may modify the second step-size value 1325 $\mu_{VAEC}$ generated by the velocity-based algorithm to switch cost functions and/or reduce a rate at which the adaptive filters update when near-end signals are detected. For example, when the near-end signal is not detected, the first step-size value 1315 $\mu_{RVSS}$ may be equal to a value of one, resulting in the third step-size value 1335 $\mu_{OUT}$ being equal to the second step-size value 1325 $\mu_{VAEC}$. However, when a near-end signal is detected, the first step-size value 1315 $\mu_{RVSS}$ may have a value between zero and one, resulting in the third step-size value 1335 $\mu_{OUT}$ being smaller than the second step-size value 1325 μVAEC. As the second step-size value 1325 $\mu_{VAEC}$ increases when the velocity increases to enable the system 100 to rapidly converge as the echo path changes, the first step-size value 1315 $\mu_{RVSS}$ slows down how quickly the adaptive filters update when near-end signals are present in order to prevent the system from diverging. Thus, the system 100 generates the third step-size value 1335 $\mu_{OUT}$ to be robust against near-end disturbances and instantaneously constrains the step-size when the impulsive noises occur.

Using the first step-size value 1315 $\mu_{RVSS}$ and the second step-size value 1325 $\mu_{VAEC}$, the system 100 may generate a RVSS weight vector 1340:

$$w_p(m, n) = w_p(m, n-1) + \mu_{RVSS} \cdot \mu_{VAEC} \cdot \frac{x_p(m, n)}{\|x_p(m, n)\|^2} \cdot e^*(m, n) \quad [21]$$

where $w_p(m, n)$ denotes the RVSS weight vector (e.g., adaptive filter coefficients weight vector) for the pth channel, mth subband, and nth sample, $\mu_{RVSS}$ denotes the robust variable adaptation step-size value generated using the RVSS algorithm, $\mu_{VAEC}$ denotes a variable adaptation step-size value generated using the velocity-based algorithm, $x_p(m, n)$ denotes the playback signal 515 (e.g., reference signal) for the pth channel, $\|x_p(m, n)\|$ denotes a vector norm (e.g., vector length, such as a Euclidian norm) associated with the playback signal 515, and $e^*(m, n)$ denotes a conjugate of the error signal 535 output by the canceller 530.

Figure 14:
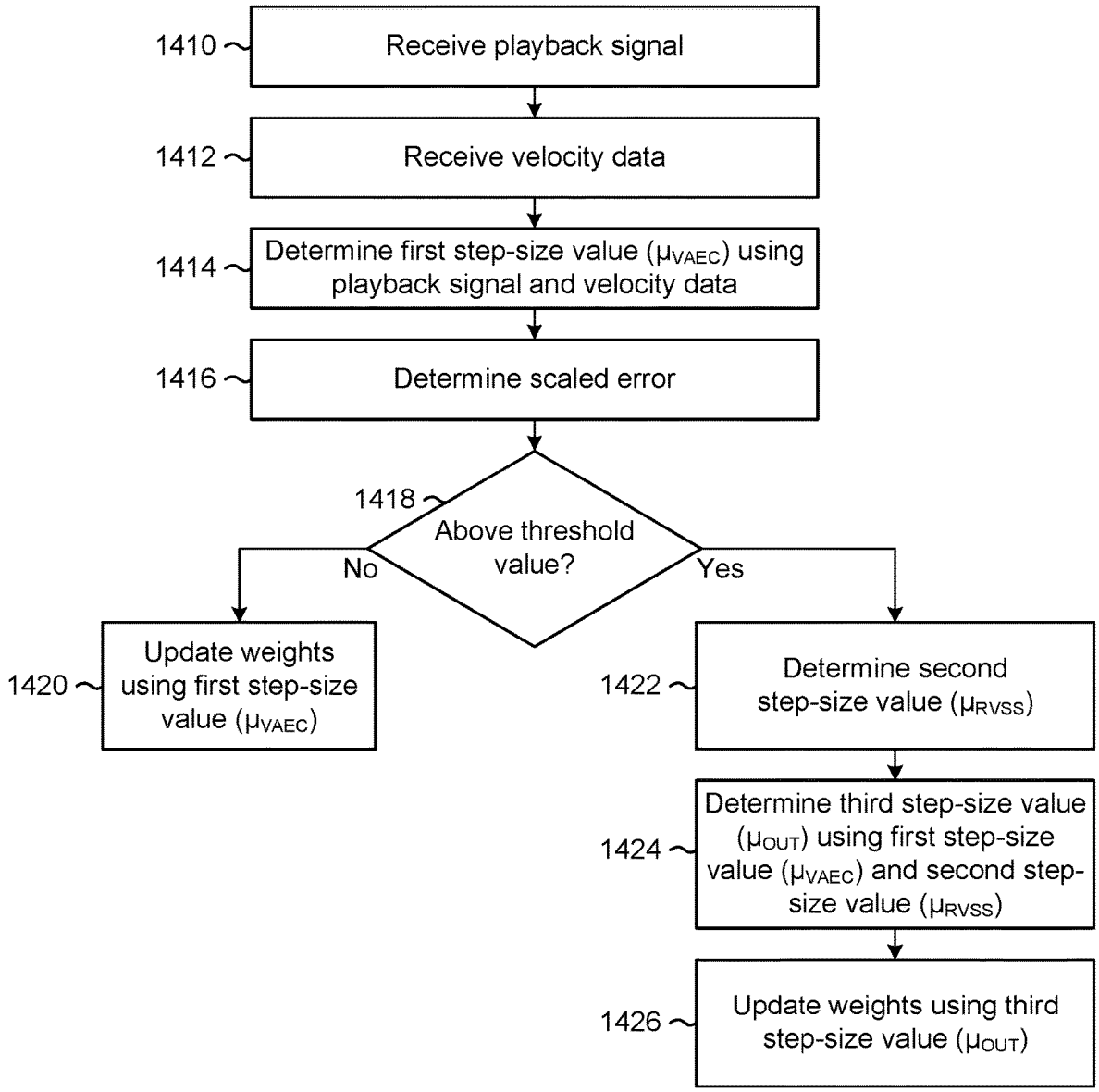
FIG. 14 is a flowchart conceptually illustrating an example method for determining when to use a robust variable step size according to embodiments of the present disclosure.

FIG. 14 is a flowchart conceptually illustrating an example method for determining when to use a robust variable step size according to embodiments of the present disclosure. As illustrated in FIG. 14, the system 100 may receive (1410) a playback signal, receive (1412) velocity data, and determine (1414) a first step-size value $\mu_{VAEC}$ using the playback signal and the velocity data. The system 100 may determine (1416) a scaled error $$\left(\text{e.g., } \frac{\|x_p(m, n)\|}{|e(m, n)|}\right),$$

and determine (1418) whether the scaled error is above a threshold value.

If the scaled error is less than or equal to the threshold value, the system 100 may update (1420) weights using the first step-size value $\mu_{VAEC}$. If the scaled error is greater than the threshold value, the system 100 may determine (1422) a second step-size value $\mu_{RVSS}$, may determine (1424) a third step-size value $\mu_{OUT}$ using the first step-size value $\mu_{VAEC}$ and the second step-size value $\mu_{RVSS}$, and may update (1426) weights using the third step-size value $\mu_{OUT}$.

As described above with regard to FIG. 1A, to further improve a performance of the RES component 130, the device 102 may smooth the RES mask across time, may smooth the RES mask across frequency subbands, and/or may apply extra echo suppression (EES) processing to further attenuate the residual echo signal.

Figure 15:
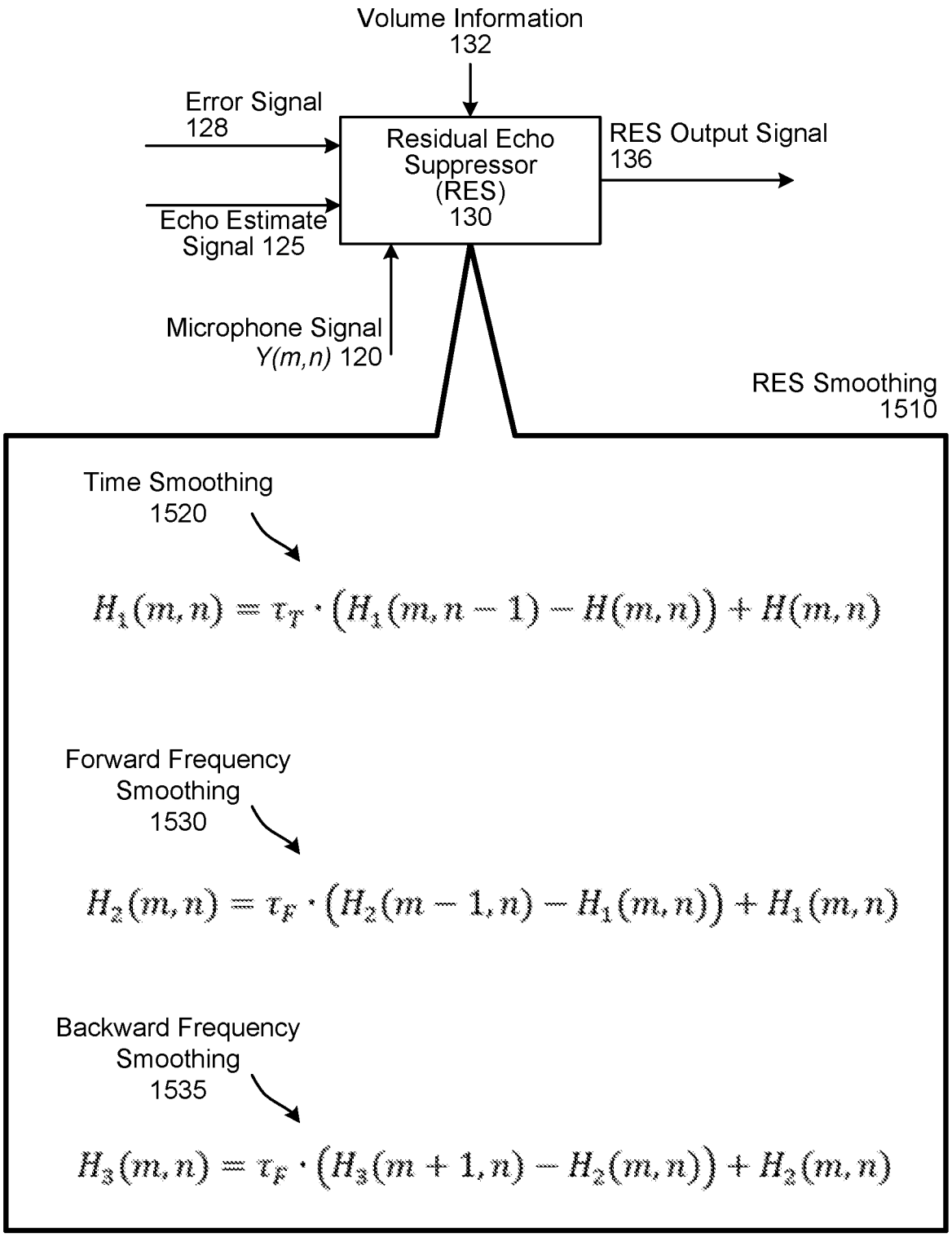
FIG. 15 illustrates examples of performing residual echo suppression smoothing according to embodiments of the present disclosure.

FIG. 15 illustrates examples of performing residual echo suppression smoothing according to embodiments of the present disclosure. After performing the RES processing 134 described above with regard to FIG. 1A to generate the RES mask H(m, n) (e.g., RES mask values determined using Equation [3]), the RES component 130 may optionally perform additional RES smoothing 1510 prior to generating the RES output signal 136 using Equation [4]. For example, the RES component 130 may perform one pole smoothing to smooth across time and/or frequency without departing from the disclosure.

In some examples, the RES component 130 may perform smoothing across time to avoid introducing artifacts or distortion when the RES mask suddenly releases from some time-frequency bins. For example, the RES component 130 may perform time smoothing 1520, as shown below:

$$H_1(m,n)=\tau_T\cdot(H_1(m,n-1)-H(m,n))+H(m,n) \quad [22]$$

where m denotes a subband bin index (e.g., frequency bin), n denotes a subband sample index (e.g., frame index), $H_1(m, n)$ is the time smoothed RES mask value for the mth subband bin index and the nth subband sample index, $\tau_T$ is a time smoothing time constant, $H_1(m, n-1)$ is the time smoothed RES mask value for the mth subband bin index and the (n−1)th subband sample index, and H(m, n) is the RES mask value for the mth subband bin index and the nth subband sample index determined using Equation [3] described above. While not illustrated in FIG. 15, the system 100 may set an initial RES mask value equal to a value of zero without departing from the disclosure (e.g., $H_1(m, 0)=0$).

The device 102 may select the time smoothing time constant $\tau_T$ to control an amount of smoothing being performed. For example, a higher time smoothing time constant $\tau_T$ corresponds to more smoothing, as the RES component 130 uses a larger weight for the previous subband sample index n−1. As the previous subband sample index n−1 was smoothed across time using an even earlier subband sample index n−2, the time smoothing time constant $\tau_T$ effectively controls how many previous sample indexes the RES component 130 uses to smooth a current RES mask value.

After performing time smoothing 1520, the RES component 130 may perform smoothing across frequencies to avoid introducing artifacts or distortion when the RES mask suddenly releases between subband bin indexes. To avoid introducing a bias, the RES component 130 smooths across frequencies using a forward-backward technique, although the disclosure is not limited thereto. For example, the RES component 130 may perform forward frequency smoothing 1530, as shown below:

$$H_2(m,n)=\tau_F\cdot(H_2(m-1,n)-H_1(m,n))+H_1(m,n) \quad [23]$$

where m denotes a subband bin index (e.g., frequency bin), n denotes a subband sample index (e.g., frame index), $H_2$ (m, n) is the forward frequency smoothed RES mask value for the mth subband bin index and the nth subband sample index, $\tau_F$ is a frequency smoothing time constant, $H_2(m-1, n)$ is the forward frequency smoothed RES mask value for the (m−1)th subband bin index and the nth subband sample index, and $H_1$ (m, n) is the time smoothed RES mask value for the mth subband bin index and the nth subband sample index determined using Equation [22] described above. While not illustrated in FIG. 15, the system 100 may set a RES mask value corresponding to a first bin index equal to an unsmoothed RES mask value without departing from the disclosure (e.g., $H_2$ (0, n)=(0, n)).

Similarly, the RES component 130 may perform backward frequency smoothing 1540, as shown below:

$$H_3(m,n)=\tau_F\cdot(H_3(m+1,n)-H_2(m,n))+H_2(m,n) \quad [24]$$

where m denotes a subband bin index (e.g., frequency bin), n denotes a subband sample index (e.g., frame index), $H_3$ (m, n) is the backward frequency smoothed RES mask value for the mth subband bin index and the nth subband sample index, $\tau_F$ is the frequency smoothing time constant, $H_3$ (m+1, n) is the backward frequency smoothed RES mask value for the (m+1)th subband bin index and the nth subband sample index, and $H_2$ (m, n) is the forward frequency smoothed RES mask value for the mth subband bin index and the nth subband sample index determined using Equation [23] described above. While not illustrated in FIG. 15, the system 100 may set a RES mask value corresponding to a maximum bin index equal to an unsmoothed RES mask value without departing from the disclosure (e.g., $H_3$ (M, n)=$H_2$ (M, n)).

The device 102 may select the frequency smoothing time constant $\tau_F$ to control an amount of smoothing being performed. For example, a higher frequency smoothing time constant $\tau_F$ corresponds to more smoothing, as the RES component 130 uses a larger weight for the previous subband bin index m−1 (e.g., during forward frequency smoothing 1530) and/or subsequent subband bin index m+1 (e.g., during backward frequency smoothing 1540). As the previous subband bin index m−1 and/or subsequent subband bin index m+1 were smoothed across frequency using neighboring subband bin indexes, the frequency smoothing time constant $\tau_F$ effectively controls how many bin indexes the RES component 130 uses to smooth a current RES mask value.

While FIG. 15 illustrates the RES component 130 performing RES smoothing 1510 using time smoothing 1520, forward frequency smoothing 1530, and backward frequency smoothing 1535, the disclosure is not limited thereto and the RES component 130 may perform RES smoothing 1510 using any combination thereof without departing from the disclosure. For example, the RES component 130 may only perform time smoothing 1520, may perform frequency smoothing using forward frequency smoothing 1530 and backward frequency smoothing 1535, may only perform forward frequency smoothing 1530 or backward frequency smoothing 1535, and/or the like without departing from the disclosure.

Thus, the RES component 130 may generate the RES output signal 136 (e.g., $RES_{out}$(m, n) determined using Equation [4]) using the RES mask H(m, n) determined using Equation [3], the time smoothed RES mask $H_1$ (m, n) determined using Equation [22], the forward frequency smoothed RES mask $H_2$(m, n) determined using Equation [23], the backward frequency smoothed RES mask $H_3$ (m, n) determined using Equation [24], and/or any RES mask generated using the techniques described above without departing from the disclosure.

Figure 16:
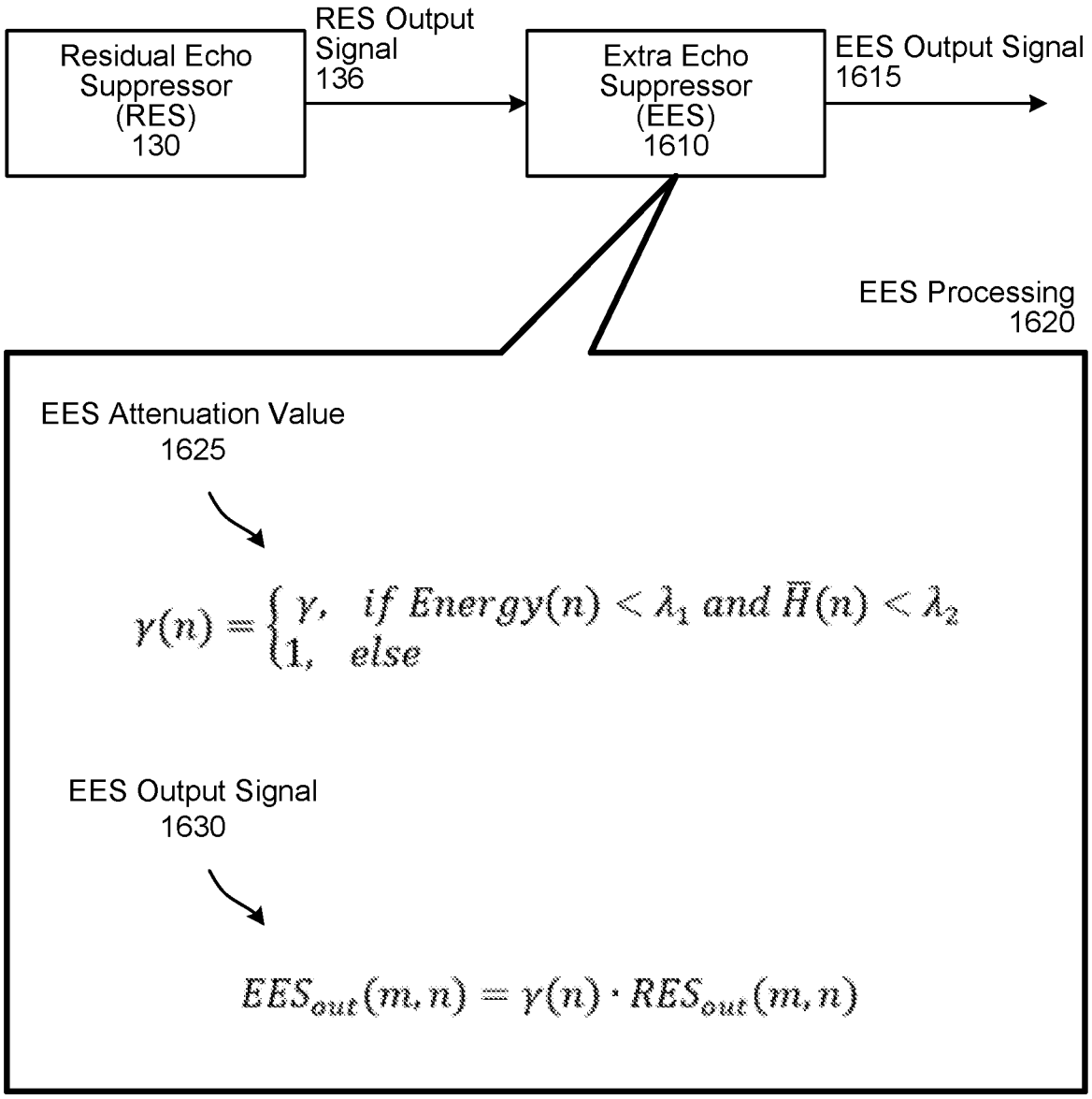
FIG. 16 illustrates examples of performing extra echo suppression processing according to embodiments of the present disclosure.

FIG. 16 illustrates examples of performing extra echo suppression processing according to embodiments of the present disclosure. After generating the RES output signal 136 using the techniques described above with regard to FIG. 1A and/or FIG. 15, the device 102 may optionally apply extra echo suppression processing to further attenuate the residual echo signal. As illustrated in FIG. 16, the device 102 may include an Extra Echo Suppressor (EES) component 1610 that receives the RES output signal 136 and applies EES processing 1620 to generate an EES output signal 1615.

The EES component 1610 may apply EES processing 1620 when certain conditions being satisfied. For example, the EES component 1610 may apply additional attenuation when a full-band output energy Energy(n) (e.g., total energy) for the RES output signal 136 is less than a first threshold value $\lambda_1$ and an average RES mask value $\bar{H}(n)$ across all m subband indexes is less than a second threshold value $\lambda_2$. FIG. 16 illustrates an example of calculating an EES attenuation value 1625 using the following equation:

$$\gamma(n)=\begin{cases}\gamma, & \text{if Energy}(n)<\lambda_1 \text{ and } \bar{H}(n)<\lambda_2\\ 1, & \text{else}\end{cases} \quad [25]$$

where n denotes a subband sample index (e.g., frame index), γ(n) is the EES attenuation value for the nth subband sample index, γ is a third tunable parameter corresponding to an amount of attenuation (e.g., −40 dB), Energy(n) is a full-band output energy for the RES output signal 136 (e.g., output energy across all m subband bin indexes), $\lambda_1$ is a first threshold value, $\bar{H}(n)$ is an average RES mask value across all m subband bin indexes, and $\lambda_2$ is a second threshold value. The average RES mask value $\bar{H}(n)$ can be calculated as shown below:

$$\bar{H}(n)=\frac{1}{m}\sum_{i=1}^{m}H(m,n) \quad [26]$$

where m denotes a subband bin index (e.g., frequency bin), n denotes a subband sample index (e.g., frame index), $\bar{H}(n)$ is an average RES mask value averaged across all m subband bin indexes, and H(m, n) is the RES mask value for the mth subband bin index and the nth subband sample index. As used herein, the RES mask value H(m, n) in Equation [26] refers generally to RES mask values, which may be determined using Equation [3], Equation [22], Equation [23], or Equation [24] without departing from the disclosure.

As illustrated in FIG. 16 and Equation [25], the EES attenuation value γ(n) is determined as a single value that is applied to all subband bin indexes m for a given subband sample index n. Thus, the EES attenuation value γ(n) applies additional broadband attenuation, which further suppresses any artifacts and/or distortion represented in the RES output signal 136.

The EES component 1610 may select a value of the third tunable parameter. For example, the EES component 1610 may set the third tunable parameter to a third value (e.g., −40 dB) corresponding to an amount of attenuation to apply when the conditions are met. However, the disclosure is not limited thereto and the third tunable parameter may vary without departing from the disclosure. Thus, the EES component 1610 may apply additional attenuation using the third tunable parameter when the full-band output energy Energy (n) for the RES output signal 136 is less than the first threshold value $\lambda_1$ and the average RES mask value $\bar{H}(n)$ is less than a second threshold value $\lambda_2$.

FIG. 16 illustrates the EES component 1610 generating an EES output signal 1630 using the following equation:

$$EES_{out}(m,n)=\gamma(n)\cdot RES_{out}(m,n) \quad [27]$$

where m denotes a subband bin index (e.g., frequency bin), n denotes a subband sample index (e.g., frame index), $EES_{out}(m,n)$ is the EES output signal 1615 for the mth subband bin index and the nth subband sample index, γ(n) is the EES attenuation value 1625 for the nth subband sample index, and $RES_{out}(m, n)$ is the RES output signal 136 for the mth subband bin index and the nth subband sample index.

Figure 17:
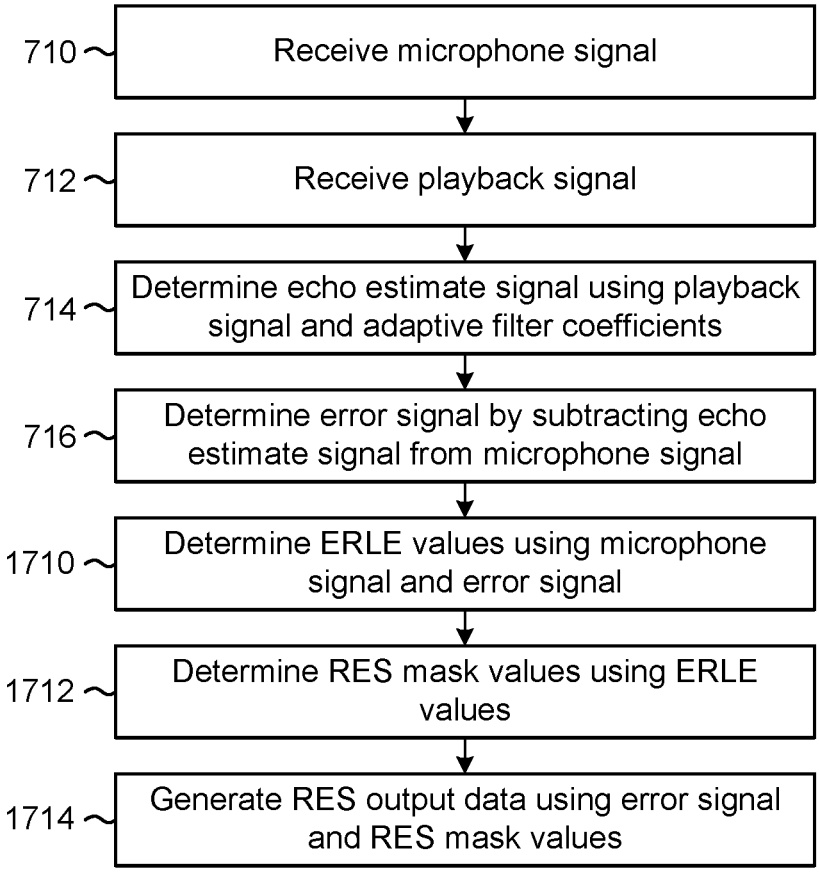
FIG. 17 is a flowchart conceptually illustrating an example method for performing residual echo suppression according to embodiments of the present disclosure.

FIG. 17 is a flowchart conceptually illustrating an example method for performing residual echo suppression according to embodiments of the present disclosure. As illustrated in FIG. 17, the system 100 may receive (710) a microphone signal, may receive (712) a playback signal, may determine (714) an echo estimate signal using the playback signal and adaptive filter coefficient values of an adaptive filter, and may determine (716) an error signal by subtracting the echo estimate signal from the microphone signal, as described in greater detail above with regard to FIG. 5. The error signal determined in step 716 corresponds to the error signal 128 output by the AEC component 104.

The system 100 may then determine (1710) ERLE values using the microphone signal and the error signal, determine (1712) RES mask values using the ERLE values, and generate (1714) RES output data using the error signal and the RES mask values, as described in greater detail above with regard to FIG. 1A and Equations [1]-[4].

Figure 18:
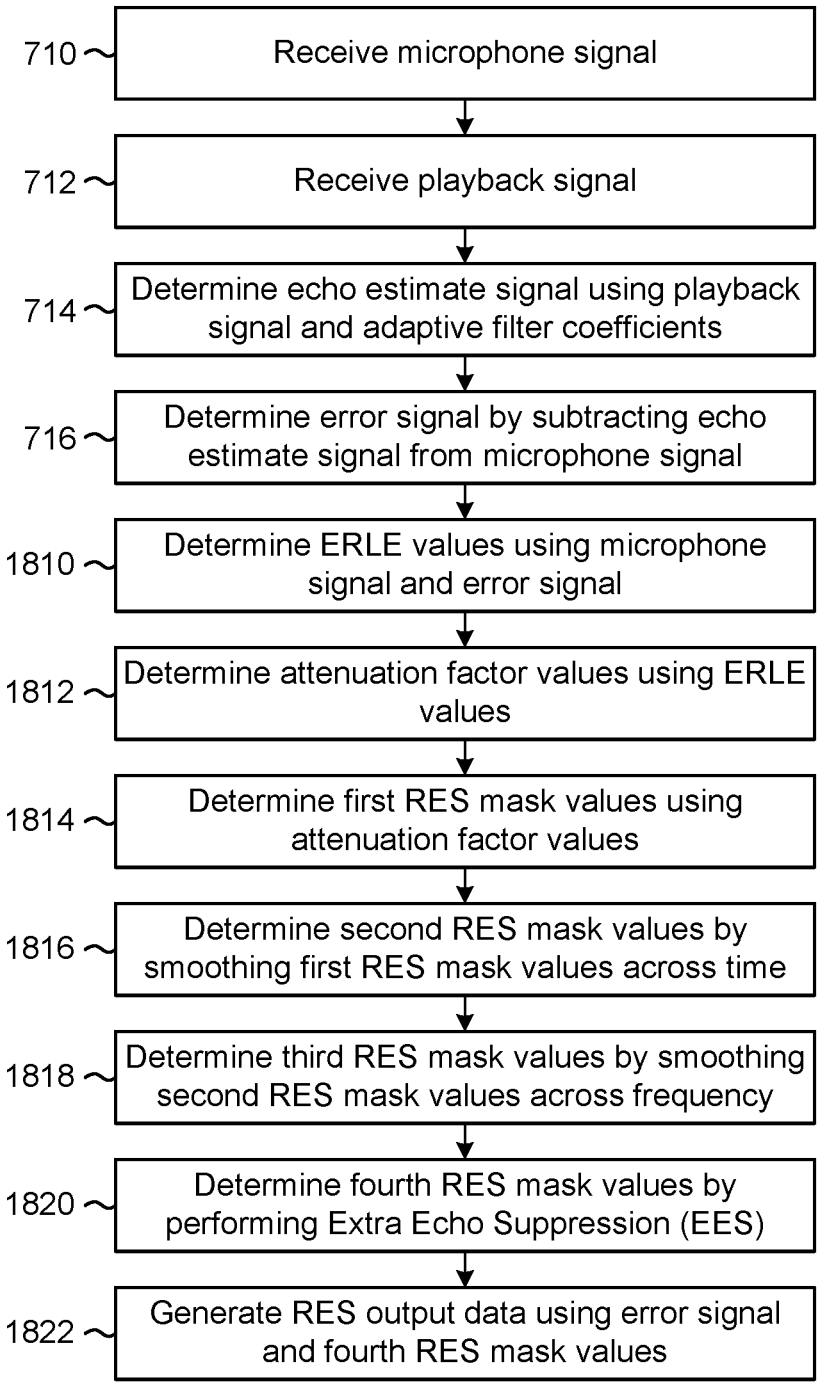
FIG. 18 is a flowchart conceptually illustrating an example method for performing residual echo suppression and smoothing according to embodiments of the present disclosure.

FIG. 18 is a flowchart conceptually illustrating an example method for performing residual echo suppression and smoothing according to embodiments of the present disclosure. As illustrated in FIG. 18, the system 100 may receive (710) a microphone signal, may receive (712) a playback signal, may determine (714) an echo estimate signal using the playback signal and adaptive filter coefficient values of an adaptive filter, and may determine (716) an error signal by subtracting the echo estimate signal from the microphone signal, as described in greater detail above with regard to FIG. 5. The error signal determined in step 716 corresponds to the error signal 128 output by the AEC component 104.

The system 100 may then determine (1810) ERLE values using the microphone signal and the error signal, determine (1812) attenuation factor values using the ERLE values, and determine (1814) first RES mask values using the attenuation factor values. For example, the system 100 may determine the ERLE values using Equation [1], may determine the attenuation factor values using Equation [2], and may determine the first RES mask values using Equation [3], which are described in greater detail above with regard to FIG. 1A.

In addition, the system 100 may determine (1816) second RES mask values by smoothing the first RES mask values across time and may determine (1818) third RES mask values by smoothing the second RES mask values across frequency. For example, the system 100 may determine the second RES mask values using Equation [22] and may determine the third RES mask values using Equation [23] and/or Equation [24], which are described in greater detail above with regard to FIG. 15. While FIG. 18 illustrates the system 100 performing both step 1816 and step 1818, the disclosure is not limited thereto and the system 100 may perform either time smoothing in step 1816 or frequency smoothing in step 1818 without departing from the disclosure. Additionally or alternatively, the system 100 may perform frequency smoothing using only the forward frequency smoothing 1530, only the backward frequency smoothing 1535, or using both the forward frequency smoothing 1530 and the backward frequency smoothing 1535 without departing from the disclosure.

Figure 19:
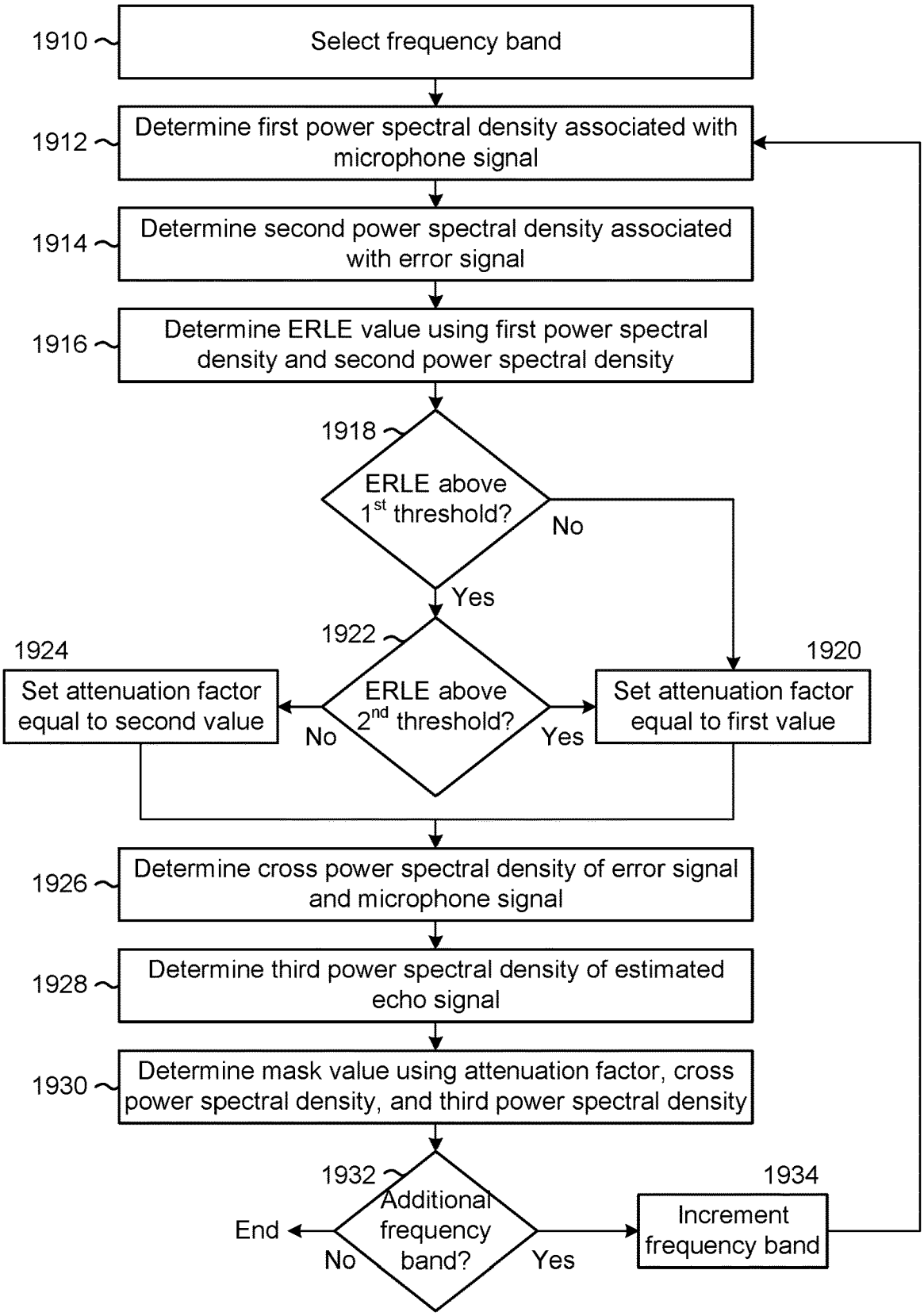
FIG. 19 is a flowchart conceptually illustrating an example method for determining mask values during residual echo suppression according to embodiments of the present disclosure.

FIG. 19 is a flowchart conceptually illustrating an example method for determining mask values during residual echo suppression according to embodiments of the present disclosure. As illustrated in FIG. 19, the system 100 may select (1910) a frequency band, may determine (1912) a first power spectral density associated with the microphone signal and the frequency band, may determine (1914) a second power spectral density associated with the error signal and the frequency band, and may determine (1916) an ERLE value using the first power spectral density and the second power spectral density. For example, the system 100 may determine the ERLE value using Equation [1] described in greater detail above with regard to FIG. 1A.

The system 100 may determine (1918) whether the ERLE value is above a first threshold value (e.g., 1.0). If the ERLE value is not above the first threshold value (e.g., ERLE<1.0), the system 100 may set (1920) an attenuation factor equal to a first value (e.g., a). If the ERLE value is above the first threshold value (e.g., ERLE≥1.0), the system 100 may determine (1922) whether the ERLE value is above a second threshold value (e.g., δ). If the ERLE value is above the second threshold value (e.g., ERLE≥δ), the system 100 may set the attenuation factor equal to the first value (e.g., a) in step 1920. If the ERLE value is not above the second threshold value (e.g., ERLE<δ), the system 100 may set (1924) the attenuation factor equal to a second value (e.g., α·β). For example, the system 100 may set the attenuation factor equal to the second value (e.g., α·β) when the ERLE value satisfies a condition, such as when the ERLE value is between the first threshold value and the second threshold value (e.g., 1.0≤ERLE<δ). When the ERLE value does not satisfy the condition, the system 100 may set the attenuation factor equal to the first value (e.g., $\alpha$), as shown in Equation [2] and described in greater detail above with regard to FIG. 1A.

After setting the attenuation factor equal to the first value or the second value, the system 100 may determine (1926) a cross power spectral density of the error signal and the microphone signal, may determine (1928) a third power spectral density of the estimated echo signal, and may determine (1930) a RES mask value using the attenuation factor, the cross power spectral density, and the third power spectral density. For example, the system 100 may determine the RES mask value using Equation [3], described in greater detail above with regard to FIG. 1A.

As illustrated in FIG. 19, the system 100 may then determine (1932) whether there is an additional frequency band, and if so, may increment (1934) the frequency band and loop to step 1912 to repeat steps 1912-1930 for the incremented frequency band. If there are no additional frequency bands, the system 100 may end processing after step 1932. While FIG. 19 illustrates an example method for determining the RES mask value, the disclosure is not limited thereto and the system 100 may perform time smoothing and/or frequency smoothing to the RES mask value prior to generating the RES output signal 136, as described above with regard to FIG. 15.

Figure 20:
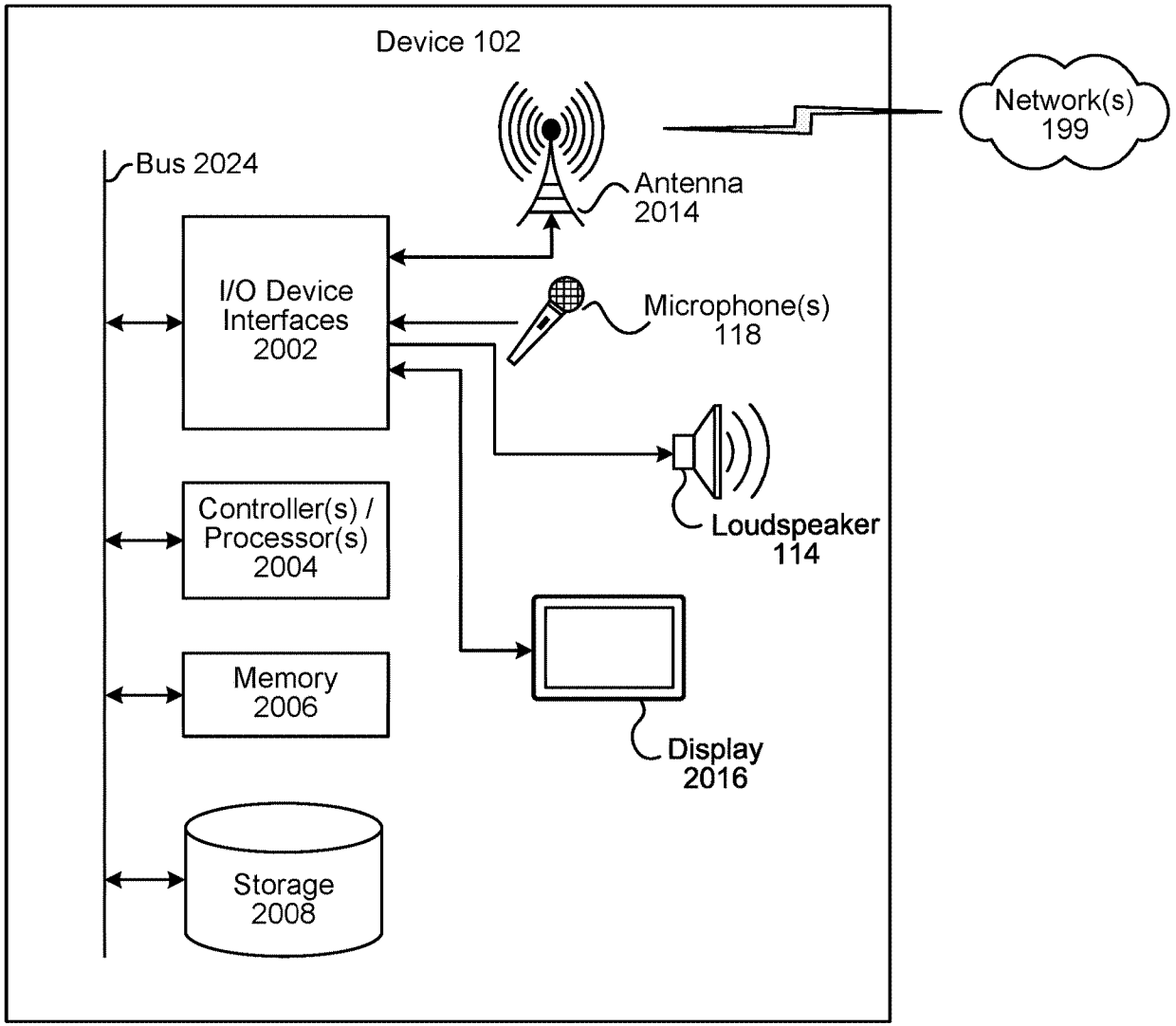
FIG. 20 is a block diagram conceptually illustrating example components of a system for echo cancellation according to embodiments of the present disclosure.

FIG. 20 is a block diagram conceptually illustrating a device 102 that may be used with the system 100. The device 102 may include one or more controllers/processors 2004, which may each include a central processing unit (CPU) for processing data and computer-readable instructions, and a memory 2006 for storing data and instructions of the respective device. The memory 2006 may include volatile random access memory (RAM), non-volatile read only memory (ROM), non-volatile magnetoresistive memory (MRAM), and/or other types of memory. The device 102 may also include a data storage component 2008 for storing data and controller/processor-executable instructions. Each data storage component 2008 may individually include one or more non-volatile storage types such as magnetic storage, optical storage, solid-state storage, etc. The device 102 may also be connected to removable or external non-volatile memory and/or storage (such as a removable memory card, memory key drive, networked storage, etc.) through respective input/output device interfaces 2002.

Computer instructions for operating the device 102 and its various components may be executed by the respective device's controller(s)/processor(s) 2004, using the memory 2006 as temporary "working" storage at runtime. A device's computer instructions may be stored in a non-transitory manner in non-volatile memory 2006, storage 2008, or an external device(s). Alternatively, some or all of the executable instructions may be embedded in hardware or firmware on the respective device in addition to or instead of software.

The device 102 includes input/output device interfaces 2002. A variety of components may be connected through the input/output device interfaces 2002, as will be discussed further below. Additionally, the device 102 may include an address/data bus 2024 for conveying data among components of the respective device. Each component within a device 102 may also be directly connected to other components in addition to (or instead of) being connected to other components across the bus 2024.

Referring to FIG. 20, the device 102 may include input/output device interfaces 2002 that connect to a variety of components such as an audio output component such as a loudspeaker 14, a wired headset or a wireless headset (not illustrated), or other component capable of outputting audio. The device 102 may also include an audio capture component. The audio capture component may be, for example, microphone(s) 118 or array of microphones, a wired headset, or a wireless headset, etc. If an array of microphones is included, approximate distance to a sound's point of origin may be determined by acoustic localization based on time and amplitude differences between sounds captured by different microphones of the array. The device 102 may optionally include a display 2016 for displaying content, although the disclosure is not limited thereto. While FIG. 20 illustrates the device 102 connecting to the loudspeaker 114, the antenna 2014, the display 2016, and the microphone(s) 118, the disclosure is not limited thereto and the device 102 may connect to any combination of these components without departing from the disclosure.

Via antenna(s) 2014, the input/output device interfaces 2002 may connect to one or more networks 199 via a wireless local area network (WLAN) (such as WiFi) radio, Bluetooth, and/or wireless network radio, such as a radio capable of communication with a wireless communication network such as a Long Term Evolution (LTE) network, WiMAX network, 3G network, 4G network, 5G network, etc. A wired connection such as Ethernet may also be supported. Through the network(s) 199, the system may be distributed across a networked environment. The I/O device interface 2002 may also include communication components that allow data to be exchanged between devices such as different physical systems in a collection of systems or other components.

The components of the device 102 may include their own dedicated processors, memory, and/or storage. Alternatively, one or more of the components of the device 102 may utilize the I/O interfaces 2002, processor(s) 2004, memory 2006, and/or storage 2008 of the device 102.

As noted above, multiple devices may be employed in a single system. In such a multi-device system, each of the devices may include different components for performing different aspects of the system's processing. The multiple devices may include overlapping components. The components of the device 102, as described herein, are illustrative, and may be located as a stand-alone device or may be included, in whole or in part, as a component of a larger device or system.

The concepts disclosed herein may be applied within a number of different devices and computer systems, including, for example, general-purpose computing systems, speech processing systems, and distributed computing environments. The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of computers and speech processing should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk, and/or other media. In addition, components of system may be implemented as in firmware or hardware, such as an acoustic front end (AFE), which comprises, among other things, analog and/or digital filters (e.g., filters configured as firmware to a digital signal processor (DSP)).

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements, and/or steps are in any way required for one or more embodiments or that one or more embodiments necessarily include logic for deciding, with or without other input or prompting, whether these features, elements, and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising:

receiving, by a first device, a first reference audio signal;

generating, by a first loudspeaker of the first device using the first reference audio signal, an audible sound;

receiving, from a microphone of the first device, a first microphone signal including a first representation of the audible sound;

determining, using the first reference audio signal and a first plurality of filter coefficient values of a first adaptive filter, a first echo estimate signal that represents a portion of the first microphone signal;

determining a first error signal by subtracting the first echo estimate signal from the first microphone signal;

determining a first power spectral density function corresponding to the first microphone signal;

determining a second power spectral density function corresponding to the first error signal;

determining a first echo return loss enhancement (ERLE) value by dividing the first power spectral density function by the second power spectral density function;

determining that the first ERLE value is above a first threshold value, the first threshold value indicating that the first adaptive filter converged;

determining that the first ERLE value is below a second threshold value, the second threshold value indicating that local speech is represented in the first error signal;

multiplying a first attenuation value by a first value to generate a second attenuation value;

determining a cross power spectral density function using the first microphone signal and the first error signal;

determining a third power spectral density function corresponding to the first echo estimate signal; and determining a first residual echo suppression (RES) mask value using the second attenuation value, the cross power spectral density function, and the third power spectral density function.

2. The computer-implemented method of claim 1, wherein the first ERLE value corresponds to a first frequency range, the method further comprising:

determining, using the first microphone signal and the first error signal, a second ERLE value corresponding to the first error signal and a second frequency range;

determining that the second ERLE is above the second threshold value;

determining a second RES mask value using the first attenuation value, the second RES mask value corresponding to the second frequency range;

generating a first portion of a first output audio signal by multiplying a first portion of the first error signal by the first RES mask value, the first portion of the first output audio signal corresponding to the first frequency range; and generating a second portion of the first output audio signal by multiplying a second portion of the first error signal by the second RES mask value, the second portion of the first output audio signal corresponding to the second frequency range.

3. The computer-implemented method of claim 1, wherein determining the first RES mask value further comprises:

determining a second value by multiplying the third power spectral density function by the second attenuation value;

determining a third value by adding the cross power spectral density function and the second value; and determining the first RES mask value by dividing the cross power spectral density function by the third value.

4. The computer-implemented method of claim 1, further comprising:

generating a first output audio signal using the first error signal and a plurality of RES mask values, the plurality of RES mask values including the first RES mask value;

determining a total energy value associated with the first output audio signal;

determining an average value of the plurality of RES mask values;

determining that the total energy value is below a third threshold value;

determining that the average value is below a fourth threshold value; and generating a second output audio signal by multiplying the first output audio signal by a third attenuation value.

5. A computer-implemented method performed by a device, the method comprising:

receiving at least one reference signal;

receiving a first audio input signal;

determining, using a first adaptive filter and the at least one reference signal, a first echo signal that represents a portion of the first audio input signal;

determining a first error signal using the first echo signal and the first audio input signal;

determining, using the first audio input signal and the first error signal, a first signal quality metric corresponding to the first error signal;

determining that the first signal quality metric satisfies a condition;

determining a first attenuation value; and determining a first residual echo suppression (RES) mask value using the first attenuation value.

6. The computer-implemented method of claim 5, wherein the first signal quality metric corresponds to a first frequency range of the first error signal, the method further comprising:

determining, using the first audio input signal and the first error signal, a second signal quality metric corresponding to a second frequency range of the first error signal;

determining that the second signal quality metric does not satisfy the condition;

determining a second attenuation value that is higher than the first attenuation value; and determining a second RES mask value using the second attenuation value.

7. The computer-implemented method of claim 5, wherein determining the first signal quality metric further comprises:

determining a first power spectral density function corresponding to the first audio input signal;

determining a second power spectral density function corresponding to the first error signal;

determining a first echo return loss enhancement (ERLE) value by dividing the first power spectral density function by the second power spectral density function, and wherein determining that the first signal quality metric satisfies the condition further comprises:

determining that the first ERLE value is above a first threshold value, and determining that the first ERLE value is below a second threshold value.

8. The computer-implemented method of claim 5, wherein determining the first RES mask value further comprises:

determining a cross power spectral density function using the first audio input signal and the first error signal;

determining a first power spectral density function corresponding to the first echo signal;

determining a second value by multiplying the first power spectral density function by the first attenuation value;

determining a third value by adding the cross power spectral density function and the second value; and determining the first RES mask value by dividing the cross power spectral density function by the third value.

9. The computer-implemented method of claim 5, wherein the first RES mask value corresponds to a first audio frame of the first error signal, the method further comprising:

determining a second RES mask value corresponding to a second audio frame of the first error signal that is prior to the first audio frame;

determining a difference between the second RES mask value and the first RES mask value;

determining a second value by multiplying the difference by a time constant value;

determining a third RES mask value by adding the first RES mask value and the second value, the third RES mask value corresponding to the first audio frame.

10. The computer-implemented method of claim 5, wherein the first RES mask value corresponds to a first frequency range, the method further comprising:

determining a second RES mask value corresponding to a second frequency range that is different than the first frequency range;

determining a difference between the second RES mask value and the first RES mask value;

determining a second value by multiplying the difference by a time constant value;

determining a third RES mask value by adding the first RES mask value and the second value, the third RES mask value corresponding to the first frequency range.

11. The computer-implemented method of claim 5, further comprising:

generating a first output audio signal using the first error signal and a plurality of RES mask values, the plurality of RES mask values including the first RES mask value;

determining a total energy value associated with the first output audio signal;

determining an average value of the plurality of RES mask values;

determining that the total energy value is below a first threshold value;

determining that the average value is below a second threshold value; and generating a second output audio signal using the first output audio signal and a second attenuation value.

12. The computer-implemented method of claim 5, wherein the first RES mask value corresponds to a first frequency range of the first error signal, the method further comprising:

determining a second RES mask value corresponding to a second frequency range of the first error signal;

generating a first portion of a first output audio signal by multiplying the first RES mask value by a first portion of the first error signal that corresponds to the first frequency range, the first portion of the first output audio signal corresponding to the first frequency range; and generating a second portion of the first output audio signal by multiplying the second RES mask value by a second portion of the first error signal that corresponds to the second frequency range, the second portion of the first output audio signal corresponding to the second frequency range.

13. A system comprising:

at least one processor; and memory including instructions operable to be executed by the at least one processor to cause the system to:

receive at least one reference signal;

receive a first audio input signal;

determine, using a first adaptive filter and the at least one reference signal, a first echo signal that represents a portion of the first audio input signal;

determine a first error signal using the first echo signal and the first audio input signal;

determine, using the first audio input signal and the first error signal, a first signal quality metric corresponding to the first error signal;

determine that the first signal quality metric satisfies a condition;

determine a first attenuation value; and determine a first residual echo suppression (RES) mask value using the first attenuation value.

14. The system of claim 13, wherein the first signal quality metric corresponds to a first frequency range of the first error signal, and the memory further comprises instructions that, when executed by the at least one processor, further cause the system to:

determine, using the first audio input signal and the first error signal, a second signal quality metric corresponding to a second frequency range of the first error signal;

determine that the second signal quality metric does not satisfy the condition;

determine a second attenuation value that is higher than the first attenuation value; and determine a second RES mask value using the second attenuation value.

15. The system of claim 13, wherein the memory further comprises instructions that, when executed by the at least one processor, further cause the system to:

determine a first power spectral density function corresponding to the first audio input signal;

determine a second power spectral density function corresponding to the first error signal;

determine a first echo return loss enhancement (ERLE) value by dividing the first power spectral density function by the second power spectral density function;

determine that the first ERLE value is above a first threshold value; and determine that the first ERLE value is below a second threshold value.

16. The system of claim 13, wherein the memory further comprises instructions that, when executed by the at least one processor, further cause the system to:

determine a cross power spectral density function using the first audio input signal and the first error signal;

determine a first power spectral density function corresponding to the first echo signal;

determine a second value by multiplying the first power spectral density function by the first attenuation value;

determine a third value by adding the cross power spectral density function and the second value; and determine the first RES mask value by dividing the cross power spectral density function by the third value.

17. The system of claim 13, wherein the first RES mask value corresponds to a first audio frame of the first error signal, and the memory further comprises instructions that, when executed by the at least one processor, further cause the system to:

determine a second RES mask value corresponding to a second audio frame of the first error signal that is prior to the first audio frame;

determine a difference between the second RES mask value and the first RES mask value;

determine a second value by multiplying the difference by a time constant value;

determine a third RES mask value by adding the first RES mask value and the second value, the third RES mask value corresponding to the first audio frame.

18. The system of claim 13, wherein the first RES mask value corresponds to a first frequency range, and the memory further comprises instructions that, when executed by the at least one processor, further cause the system to:

determine a second RES mask value corresponding to a second frequency range that is different than the first frequency range;

determine a difference between the second RES mask value and the first RES mask value;

determine a second value by multiplying the difference by a time constant value;

determine a third RES mask value by adding the first RES mask value and the second value, the third RES mask value corresponding to the first frequency range.

19. The system of claim 13, wherein the memory further comprises instructions that, when executed by the at least one processor, further cause the system to:

generate a first output audio signal using the first error signal and a plurality of RES mask values, the plurality of RES mask values including the first RES mask value;

determine a total energy value associated with the first output audio signal;

determine an average value of the plurality of RES mask values;

determine that the total energy value is below a first threshold value;

determine that the average value is below a second threshold value; and generate a second output audio signal using the first output audio signal and a second attenuation value.

20. The system of claim 13, wherein the first RES mask value corresponds to a first frequency range of the first error signal, and the memory further comprises instructions that, when executed by the at least one processor, further cause the system to:

determine a second RES mask value corresponding to a second frequency range of the first error signal;

generate a first portion of a first output audio signal by multiplying the first RES mask value by a first portion of the first error signal that corresponds to the first frequency range, the first portion of the first output audio signal corresponding to the first frequency range; and generate a second portion of the first output audio signal by multiplying the second RES mask value by a second portion of the first error signal that corresponds to the second frequency range, the second portion of the first output audio signal corresponding to the second frequency range.

* * * * *